US005485016A

United States Patent [19]

Irie et al.

[11] Patent Number: 5,485,016

[45] Date of Patent: Jan. 16, 1996

[54] ATMOSPHERIC PRESSURE IONIZATION MASS SPECTROMETER

[75] Inventors: Takashi Irie, Kokubunji; Yasuhiro Mitsui, Fuchuu; Kazuaki Mizokami, Kodaira; Katsumi Kuriyama, Koganei, all of Japan

[73] Assignees: Hitachi, Ltd.; Hitachi Tokyo Electronics Co., Ltd., both of Tokyo, Japan

[21] Appl. No.: 231,847

[22] Filed: Apr. 25, 1994

[30] Foreign Application Priority Data

Apr. 26, 1993 [JP] Japan ..... 5-099100

[51] Int. Cl.[6] ..... H01J 49/26

[52] U.S. Cl. ..... 250/288; 250/281

[58] Field of Search ..... 250/281, 282, 250/288, 289

[56] References Cited

U.S. PATENT DOCUMENTS

| | | | |
|---|---|---|---|
| 4,023,398 | 5/1977 | French et al. . | |
| 4,144,451 | 3/1979 | Kambara | 250/281 |
| 4,647,772 | 3/1987 | Lewis et al. | 250/282 |
| 4,769,540 | 9/1988 | Mitsui et al. | 250/288 |
| 4,888,482 | 12/1989 | Kato | 250/281 |
| 4,948,962 | 8/1990 | Mitsui et al. | 250/288 |
| 5,170,052 | 12/1992 | Kato | 250/288 |
| 5,218,203 | 6/1993 | Eisele et al. | 250/282 |
| 5,304,797 | 4/1994 | Irie et al. . | |
| 5,306,412 | 4/1994 | Whitehouse et al. | 250/288 |
| 5,349,186 | 9/1994 | Ikonomou et al. | 250/288 |

FOREIGN PATENT DOCUMENTS 60-241634 11/1985 Japan .

*Primary Examiner*—Davis L. Willis
*Assistant Examiner*—Kiet T. Nguyen
*Attorney, Agent, or Firm*—Fay, Sharpe, Beall, Fagan, Minnich & McKee

[57] ABSTRACT

A mass spectrometer for analyzing trace impurities on a level between ppt and ppb contained in silicon material gas such as monosilane gas. The mass spectrometer includes an ion formation region, reaction region, and mass analysis region. Ion formation gas is introduced into the ion formation region and sample gas (silicon material gas) is introduced into the reaction region. The ion formation region ionizes ion formation gas by an ionizer and forms primary ions. When the pressure of ion formation gas is made higher than the pressure of sample gas, the ion formation gas flows into the reaction region from the ion formation region together with primary ions and is mixed with the sample gas. In the reaction region, an ion-molecule reaction is produced between the primary ions and trace impurities contained in the sample gas and the trace impurities contained in the sample gas are ionized. The ion intensity of trace impunities, the concentration of trace impurities in the sample gas is determined using a calibration curve. When the gas pressure in the reaction region is kept at almost 1 atmosphere, the reaction is promoted and when the ion-molecule reaction time is optimized according to the size of the reaction region and the voltage condition, impurities on a level between ppt and ppb can be detected and determined.

29 Claims, 15 Drawing Sheets

ATMOSPHERIC PRESSURE IONIZATION MASS SPECTROMETER

BACKGROUND OF THE INVENTION

The present invention relates to an atmospheric pressure ionization mass spectrometer and more particularly to an atmospheric pressure ionization mass spectrometer which is suitable for analyzing impurities contained in silicon group gases which generate solid deposits by ionization by discharge and have a property to pollute the ion source thereby.

As refinement of semiconductor devices has advanced recently, even trace impurities contained in gases may affect device performance. Therefore, it is necessary to supply highly purified gas in the production process and a highly purified gas analyzer is essential to manufacture and management of this gas. An atmospheric pressure ionization mass spectrometer (APIMS) can analyze trace impurities (on a level between ppb and ppt) in gases such as nitrogen and argon, so that it is an essential measuring instrument in the semiconductor device manufacturing process.

A conventional APIMS is, for example, as shown in FIG. 15. This apparatus is described in U.S. Pat. No. 4,023,398. In an ion source 151, sample gas 2 at almost 1 atmosphere is ionized by discharge or radiation. Formed sample gas ions cause an ion-molecule reaction and trace components contained in the sample gas are ionized highly efficiently. Formed trace component ions are transmitted by the electric field, pass through a gas curtain chamber 152, pass through an aperture furthermore, enter an analysis region 24, and then are mass-separated and detected. To prevent the sample gas 2 from entering the analysis region 24, curtain gas 153 is controlled so as to flow into the ion source 151 from the gas curtain chamber 152.

In FIG. 15, a reference numeral 154 indicates liquid helium, 155 a cryopump, and 156 flow of curtain gas.

Another apparatus is as shown in FIG. 16. This apparatus is described in Japanese Patent Application Laid-Open No. 60-241634. The apparatus consists of an ion formation region 5, a sample inlet 161, and a mass analysis region 24 which has an aperture 19 for introducing ions and is exhausted by a vacuum pump. The ion formation region 5 discharges ion formation gas such as nitrogen gas and forms ions. Formed ions are gushed into the atmosphere together with ion formation gas. On the other hand, sample gas 2 is gushed from the sample inlet 161. Immediately before the aperture 19, ions are mixed with sample gas 2, collide with molecules of target trace component contained in the sample gas, cause an ion-molecule reaction, and ionize the target component. Formed target component ions are sucked in the mass analysis region 24 under high vacuum via the aperture 19 and mass-separated by a mass analysis means and detected.

In FIG. 16, a reference numeral 1 indicates primary ion formation gas, 162 a mixing region of sample gas and primary ions, and 163 a mixture of primary ions and primary ion formation gas.

Still another apparatus is as shown in FIG. 17. This apparatus is described in Japanese Patent Application Laid-Open No. 60-241634. The apparatus consists of an ion formation region 5, a differential pumping region 171, a sample inlet 161, and a mass analysis region 172 which has an aperture 19 for introducing ions. The ion formation region 5 discharges ion formation gas such as nitrogen gas and forms ions. Ions formed by the ion formation region are sucked in the differential pumping region 171 together with gas, mixed with sample gas there, and cause an ion-molecule reaction. The target trace component contained in the sample gas is ionized. Target component ions formed by the differential pumping region 171 pass through the aperture 19, and enter the mass analysis region 172, and are mass-separated and detected.

Furthermore, in U.S. patent application Ser. No. 08/016,534 which was filed on Feb. 11, 1993 and is now placed in condition for allowance, a further apparatus shown in FIG. 18 is described. This apparatus consists of an ion source 285 and a drift tube 296 and the ion source 285 is separated into three chambers. Ions of purified gas 290 which are formed in the first chamber farthest from the drift tube 296 are transmitted by the electric field and introduced into the third chamber closest to the drift tube 296. In the third chamber, ions of purified gas 290 cause an ion-molecule reaction to sample gas 281 and ions of the main component of sample gas 281 are formed. Ions of the main component of this sample gas 281 are detected by the drift tube 296. The amount of ions of the main component of sample gas 281 varies with the concentration of impurities contained in the sample gas, so that by measuring this amount, the concentration of impurities contained in the sample gas can be measured.

In FIG. 18, a reference numeral 281 indicates sample gas, 282 and 287 pressure regulators, 283, 288, and 328 flow controllers, 284 a needle electrode, 285 an ion source, 286, 291, 311, and 327 exhaust gases, 289 and 329 purifiers, 290 purified gas, 292 and 292' ion extraction electrodes, 293 a shutter, 294 an electrode, 295 a detector, 296 a drift tube, 305, 306, 310, and 326 outlets, 307, 308, 316, and 325 insulators, and 324 an ion source container.

In semiconductor device manufacturing processes, many types of gases are generally used. However, since silicon group gases such as monosilane and disilane are used as materials of semiconductor layers, particularly high purification is important. Impurities such as water and oxygen cause formation of dust and formation of native oxide films in the reactor which are factors of process defects. It is requested to reduce these impurities below a ppb level. For that purpose, a super high sensitive gas analysis art for evaluating those impurities on a level between ppt and ppb is essential. Regarding so-called stable gases such as nitrogen, oxygen, and argon, the conventional APIMS can analyze impurities on a ppt level. However, regarding silicon group gases, it cannot analyze impurities on a ppt level.

SUMMARY OF THE INVENTION

According to the consideration of the inventors, the reason that the conventional APIMS cannot analyze super high sensitive impurities of silicon group gases is as shown below.

In the apparatus described in U.S. Pat. No. 4,023,398 (shown in FIG. 15), sample gas is ionized directly by discharge or radiation. Since silicon group gases are unstable gases, they will be decomposed easily by ionization by discharge or radiation. Radicals and ions formed by decomposition are very active and cause polymerization reaction or adsorption to the inner wall surface of the ion source. Therefore, solid silicon compounds are deposited in large quantities inside the ion source. The deposits produce bad effects such as reducing the ionization efficiency by shielding radiation and making discharge unstable by disturbing the electric field inside the ion source, so that stable ionization cannot be continued.

Next, in the apparatus described in Japanese Patent Application Laid-Open No. 60-241634 (shown in FIG. 16), the ion formation region and the sample inlet are separated spatially from each other and sample gas is not discharged directly. Therefore, the ion formation region will not be polluted by deposits. However, the apparatus is structured so as to gush sample gas into the atmosphere, so that silicon group gas is changed to a solid of silicon oxide immediately when it comes in contact with oxygen in the atmosphere. The solid of silicon oxide is sprayed in the neighborhood of the aperture of the mass analysis region. Therefore, the aperture clogs and ions cannot be detected. Most material gases of semiconductors such as arsine and phosphine including monosilane and disilane are severely toxic and cannot be gushed into the atmosphere often. Therefore, it is necessary to isolate the region where sample gas and ions are mixed from the atmosphere perfectly. However, when the region where ions and sample gas are mixed is simply surrounded and isolated from the atmosphere, the amount of ions is decreased remarkably. The reason is that since the flow of gas gets disordered extremely in the surrounding region, ions are dissipated by the disordered flow of gas before reaching the aperture. Since the amount of ions which are detected decreases remarkably, it is impossible to detect impurities highly sensitivity.

Furthermore, another apparatus described in Japanese Patent Application Laid-Open No. 60-241634 (shown in FIG. 17) consists of an ion formation region, a differential pumping region, a sample inlet, and a mass analysis region which has an aperture for introducing ions. Ions formed by the ion formation region are sucked in the differential pumping region together with gas, mixed with sample gas there, and cause an ion-molecule reaction. Trace impurities contained in the Sample gas are ionized. Ions formed by the differential pumping region pass through the aperture, and enter the mass analysis region, and are mass-separated and detected. In this apparatus, the sample gas is isolated from the air and will not be discharged directly, so that there are no effects of deposits and reaction to the atmosphere. However, the differential pumping region is generally evacuated at less than several torrs, so that the collision frequency between ions and molecules, that is, the chance of ion-molecule reaction will be reduced at least in three digits compared with that at the atmospheric pressure. As a result, the ionization efficiency of ions is reduced and the detection limit ranges only from a ppb level to a ppm level.

Furthermore, the above apparatus described in U.S. patent application Ser. No. 08/016,534 (shown in FIG. 18) consists of an ion source and drift tube. The ion source consists of three chambers and sample gas is not discharged directly, so that no deposits are generated. Since the ion source is isolated from the atmosphere, sample gas which is apt to react to oxygen also can be measured. The region (the third chamber) where sample gas is introduced is kept at almost 1 atmosphere, so that an ion-molecule reaction is caused efficiently. However, for the purpose of miniaturization of the apparatus, the above prior art uses a drift tube which has a low mass resolution as a detection means, so that it is impossible to separate and detect impurities for analysis from other types of impurities. Furthermore, due to a low signal-to-noise (S/N) ratio and effects of an interfering reaction caused in the drift tube, the detection limit of impurities is a ppb level. Therefore, a means for detecting impurities on a ppt level is not suggested and mentioned.

As mentioned above, in every conventional apparatus, trace impurities on a ppt level which are contained in silicon group gases such as monosilane and disilane cannot be measured high sensitivity and stably for many hours.

An object of the present invention is to eliminate the difficulties of the prior arts mentioned above and to provide an APIMS which can detect trace impurities on a level between ppt and ppb which are contained in silicon group gases high sensitivity and stably for many hours.

The atmospheric pressure ionization mass spectrometer of the present invention consists of an ion formation region, reaction region, and mass analysis region. The ion formation region ionizes ion formation gas by an ionization means such as corona discharge and forms primary ions. The reaction region mixes primary ions which are supplied from the ion formation region together with ion formation gas with sample gas, causes an ion-molecule reaction, and forms ions of trace impurities in the sample gas. The mass analysis region is kept highly evacuated and mass-separates ant detects ions of trace impurities supplied from the reaction region via the aperture. Since the reaction region is not exposed to the atmosphere, gases which are reactive to the atmosphere or toxic also can be analyzed.

According to the above constitution of the present invention, sample gas introduced into the reaction region is kept at almost 1 atmosphere, though it is slightly lower than the pressure of ion formation gas. As a result, primary ions and ion formation gas all flow into the reaction region from the ion formation region and sample gas will not flow backward into the ion formation region. Therefore, sample gas is not discharged directly but only ionized secondarily by the ion-molecule reaction in the reaction region. Since the ionization by the ion-molecule reaction is a low energy process compared with discharge, the decomposition of sample gas molecules is suppressed and no solid deposits will be generated. Therefore, the ion formation region and reaction region are not polluted and sample gas can be analyzed stably for many hours. Furthermore, when an ion extraction electrode is installed between the ion formation region and mass analysis region, an electric field is formed in the reaction region in the direction from the ion formation region to the mass analysis region. Even if the gas flow is disordered by mixing of gases in the reaction region, the transmission efficiency of ions can be improved by this electric field and the amount of ions which are detected by the mass analysis region via the aperture can be increased. In addition, when the reaction time of the ion-molecule reaction at the reaction region is optimized, the detectability becomes further improved and it becomes possible to detect the impurities on a level between ppt and ppb.

The ion-molecule reaction time can be optimized as shown below.

The detection amount I of impurity ions is expressed as shown below using a reaction time of t, a reaction rate constant of k, and a concentration of impurities (number density of molecule) of C:

$$I=I_o\,(1-exp\,(-k\cdot C\cdot t))\,(1-exp\,(-\alpha/t)) \qquad (1)$$

where $I_o$ indicates the detection amount of primary ions (hereinafter called an initial ion amount) when there is no reaction region provided and $\alpha$ indicates a constant (almost 80 μs experimentally) which is decided by diffusion of ions in the reaction region. The reaction time t is the residence time of primary ions in the reaction region and is expressed as shown below.

$$t=L^2/(K\cdot Vx) \qquad (2)$$

K indicates the mobility of ions in the reaction chamber, L the length of the reaction chamber (cm) (or distance between the ion extraction electrodes), and Vx the potential difference (V) in the reaction chamber. The typical values of k and K are $10^{-9}$ $cm^3/s$ and 3 $cm^2/(V \cdot s)$ respectively. The relationship between the amount of impurity ions (relative value when the initial ion amount is assumed as 1) at each impurity concentration and the reaction time t is shown in FIG. 6.

The lower limit of impurity concentration which can be determined depends on the SN ratio of the apparatus. A high performance mass spectrometer can detect $10^6$ in the dynamic range, that is, $10^{-6}$ of the initial ion amount. Therefore, to analyze impurities on a ppt level, it is necessary that the ion amount of impurity at 1 ppt is at least $10^{-6}$. For that purpose, as shown in FIG. 6, it is necessary that the reaction time is at least: about 30 μs or at most $10^4$ when it is converted into $Vx/L^2$.

If the ion amount I is saturated when the concentration increases, it may be considered as an upper limit of determination. A change in the ion amount due to the ion-molecule reaction is given by the term of "1−exp (−k·C·t)" of Expression (1). Therefore, a guideline of saturation of the ion amount is a concentration when the term becomes "1−(1/e)" (e indicates a natural logarithm). Namely:

$$CH=1/kt \quad (3)$$

From a practical viewpoint, it is desirable that the upper limit of determination is 100 ppb ($10^{-7}$ $N_0$, $N_0$ indicates a Loschmidt's number of $2.7\times10^{19}/cm^3$). Therefore, $10^{-7}$ $N_0<1/kt$, that is, it is necessary that t is at most 300 μs or at least $10^3$ when it is converted into $Vx/L^2$.

From the above mentioned, the detection limit is a ppt level and to determine within a concentration range from ppt to ppb, it is necessary that the following inequality is satisfied as a constitution condition of the reaction region:

$$10^3<VX/L^2<10^4 \quad (4)$$

This condition is shown in FIG. 9. The condition corresponds to the hatched part expressed by Expression (4) in principle. However, to manufacture a practical apparatus, it is necessary to set the voltage Vx of the reaction region to at most 3 kV under the restriction of breakdown voltage of the apparatus. When the length L of the reaction region is too short, primary ions and sample gas cannot be mixed sufficiently, and the formation amount of impurity ions decreases, and the sensitivity lowers. Therefore, it is necessary that the length is at least 3 mm and the values of L and Vx in the region surrounded by the straight line AB, curve BC, straight line CD, and curve DA shown in FIG. 9 are suitable. A region in which Vx is at most 2 kV and L is at least 5 mm is more desirable, that is, the values of L and Vx in the region surrounded by the straight line EF, straight line FG, and curve GE shown in FIG. 9 are more suitable.

In FIG. 9, when the detection limit is 10 ppt, the detection limit curve is shifted leftward (the distance of the reaction region is short in the direction) as shown in the drawing. When the upper limit of determination is 10 ppb, the determination limit curve is shifted downward (the voltage of the reaction region is low in the direction) as shown in the drawing. The region where the value of $Vx/L^2$ is suitable is expanded in both cases. When the detection limit is 1–10 ppt, a corresponding curve is located between the two detection limit curves. When the upper limit of determination is 100–10 ppb, a corresponding curve is located between the two determination upper limit curves.

According to the present invention, the primary ion formation means and mass analysis means employed in prior art may be used.

It is desirable that the diameter of the aperture (for example, indicated by a reference numeral 19 shown in FIG. 1) which is installed on the boundary between the reaction region and mass analysis region is between 10 μm and 300 μm. When the diameter of the aperture is less than 10 μm, machining for forming the aperture is difficult and the sensitivity lowers because the ion amount flowing into the analysis region decreases. When the diameter of the aperture is more than 300 μm, gas flows into the mass analysis region (vacuum region) remarkably, and it is necessary to use a vacuum pump with high pumping speed or to perform multi-step differential pumping, and the apparatus becomes large and complicated. Therefore, when the diameter of the aperture is less than 10 μm or more than 300 μm, it is not desirable.

It is desirable that the diameter of the opening (for example, indicated by a reference numeral 16 shown in FIG. 1) at the outlet of the ion formation region is between 2 mm and 8 mm. When the opening is smaller than this range, the ion amount into the reaction region decreases and the sensitivity lowers. When the opening is larger than this range, the backward flow of sample gas from the reaction region cannot be ignored and the discharge becomes unstable. Both cases are not desirable.

The following gases can be used as primary ion formation gas and gas to be added to it.

i) Gas using a charge-transfer reaction: Ions with large ionization potential (Ip) form ions with small ionization potential. N2 (Ip: 15.6 eV), Ar (Ip: 15.8 eV), and He (Ip: 24.6 eV) may be listed as such gases. In this case, for example, Xe (Ip: 12.1 eV) and $C_2H_6$ (Ip: 11.5 eV) can be used as gases Y to be added which will be described later.

ii) Gas using a proton shift reaction: Ions with small proton affinity (PA) form ions with large proton affinity. $H_2$ (PA: 101.3 kcal/mol) may be listed such a gas. In this case, for example, $SO_2$ (PA: 161.6 kcal/mol) can be used a gas Y to be added which will be described later.

iii) Gas using a negative ion reaction: Ions with small electron affinity (EA) form ions with large electron affinity. $SF_6$ (EA: 0.75 eV) may be listed such a gas. In this case, for example, $CH_3O$ (EA: 1.57 eV) can be used a gas Y to be added which will be described later.

Ip of monosilane $SiH_4$ is 12.4 eV, and PA is 154 kcal/mol, and EA is at most 1.4 eV.

For causing the ion-molecule reaction irreversibly, it is generally necessary that this reaction is exothermic. Therefore, the relative magnitude of IP, PA, or EA corresponding to it is necessary. For example, when a mixture of $N_2$ gas and Xe gas of about 100 to 600 ppm is used as a primary ion formation gas and an impurity of $NH_3$ (Ip: 10 eV) in monosilane $SiH_4$ gas is to be detected, the following relationship is held.

$$I_p\ (N_2)>I_p\ (SiH_4)>I_p\ (Xe)>I_p\ (NH_3)$$

Idealistically, therefore, $N_2^+$ formed by discharge forms $X_e^+$ by a charge-transfer reaction in the ion formation region and $Xe^+$ forms $NH_3^+$ by a charge-transfer reaction in the reaction region. As a result, $NH_3$ can be detected.

Since the reaction that $Xe^+$ forms $SiH_4^+$ in the reaction region is an endothermic reaction, it cannot be caused irreversibly. Therefore, the main component of $SiH_4$ of sample gas is not ionized, so that only impurity of $NH_3$ is ionized and detected.

When sample gas flows backward into the ion formation region from the reaction region, it is not desirable because the sample gas is directly ionized by discharge, and silicon group gas is easily decomposed as mentioned above, and solid silicon compounds are deposited inside the ion source. To prevent the sample gas from flowing backward into the ion formation region, the pressure of ion formation gas is made higher than the pressure of sample gas. Namely, assuming that the reaction region is at 1 atmosphere, the pressure of the ion formation region is made higher than the pressure (1 atmosphere) of the reaction region by the pressure necessary to flow a predetermined amount (amount sufficient enough to keep discharge stable) of ion formation gas into the reaction region from the ion formation region. This pressure necessary for the ion formation region varies with the diameter of the opening (for example, indicated by a reference numeral 16 shown in FIG. 1) at the outlet of the ion formation region. It is desirable to decide a pressure for keeping discharge stable accurately and experimentally in,each case.

It is necessary to keep the mass analysis region in an atmosphere of a vacuum suitable for mass analysis (normally, for example, about $10^{-4}$ to $10^{-6}$ torr).

DESCRIPTION OF THE PREFERRED EMBODIMENTS

Embodiment 1

Figure 1:
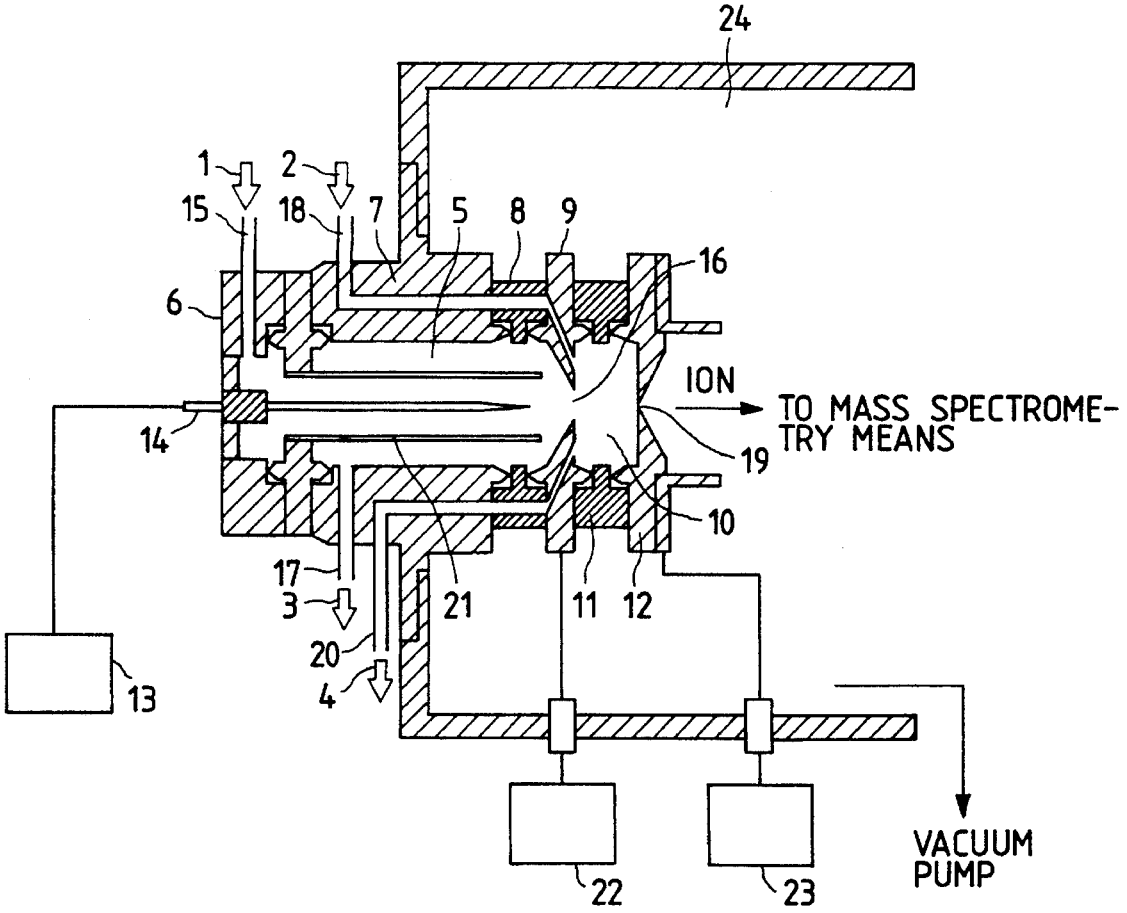
FIG. 1 is a schematic cross sectional view showing an atmospheric pressure ionization mass spectrometer of an embodiment of the present invention.

Next, this embodiment will be explained with reference to FIG. 1. An example that nitrogen gas ($N_2$) is used as primary ion formation gas 1, monosilane gas ($SiH_4$) as sample gas 2, and moisture ($H_2O$) as a trace impurity to be analyzed contained in the sample gas 2 will be explained hereunder.

An ion formation region 5 is a region surrounded by a first body 6, a second body 7, a first insulator 8, and a first electrode 9. A reaction region 10 is a region surrounded by the first electrode 9, a second insulator 11, and a second electrode 12. A sample inlet is a gas flow path which is formed by running through the second body 7, the first insulator 8, and the first electrode 9. By the structure of the gas flow path of this constitution, the ion source can be miniaturized. Inside the ion formation region 5, a needle electrode 14 to which a high voltage is applied by a power source 13 is installed. To prevent abnormal discharge and let gas 1 flow to an opening 16, a cylindrical glass tube 21 is installed in the neighborhood of the needle electrode 14. When a substance which is the same as the impurity to be analyzed in the sample gas or an impurity having an ionization potential lower than that of the impurity to be analyzed is contained in the ion formation gas, the analytical precision and sensitivity lower due to rise in noise of the background and reduction in the reaction efficiency. This impurity contained in the ion formation gas is removed by a purifier (not shown in the drawing) such as a molecular sieve trap, liquid nitrogen trap, chemical adsorption type purifier, or getter type purifier.

The nitrogen gas 1 is at almost 1 atmosphere, is introduced into the ion formation region 5 from a first gas inlet 15, and ionized by corona discharge generated at the tip of the needle electrode 14, and ions $N_4$+are formed as shown below.

$$N_2^+ \rightarrow N_2^+ \text{(Corona discharge)} \quad (5)$$

$$N_2^+ + 2N_2 \rightarrow N_4^+ + N_2 \quad (6)$$

A part of the gas 1 flows into the reaction region 10 from the opening 16 of the first electrode. Primary ions are introduced into the reaction region 10 by this gas flow and the potential difference (this is given by the power sources 13 and 22) between the needle electrode 14 and the first electrode 9. The remaining part (gas 3) of the gas 1 is ejected outside the ion formation region from a gas outlet 17. By controlling the flow rate of the gas 3 to a value smaller than the flow rate of the gas 1, the sample gas 2 can be prevented from flowing into the ion formation region 5 from the reaction region 10.

The sample gas 2 is made slightly lower in pressure than the gas 1 (lower by about 0.1 atmosphere) and introduced from a gas inlet 18. The primary ions and sample gas are mixed in the reaction region 10 and moisture is ionized by the following ion-molecule reactions as molecule cluster ions of $SiH_3OH_2^+$.

$$N_4^+ + SiH_4 \rightarrow SiH_3^+ + H + 2N_2 \quad (7)$$

$$SiH_3^+ + SiH_4 + M \rightarrow Si_2H_7^+ + M \ (M: N_2 \text{ or } SiH_4) \quad (8)$$

$$Si_2H_7^+ + H_2O \rightarrow SiH_3OH_2^+ + SiH_4 \quad (9)$$

Since the ion formation gas 1 and sample gas 2 are mixed sufficiently in the reaction region 10, $SiH_3OH_2$ is formed highly efficiently. The formed ions are transmitted by the potential difference (this is given by the power sources 22 and 23) between the first electrode 9 and the second electrode 12, introduced into a mass analysis region 24 in a high vacuum via an aperture 19 of the second electrode 12, and mass-separated and detected.

After impurities are ionized, the sample gas 2 is ejected from a gas outlet 20 as exhaust gas 4.

The excess energy (calorific value) generated by the reaction (7) is about 1.6 eV and the reaction (7) is very moderate ionization compared with ionization by discharge or electron impact in which excess energy of at least 10 eV is generally generated. Therefore, excitation or dissociation of molecules is suppressed, so that ions having a property that they are apt to deposit as solid silicon and radicals are suppressed in formation. As a result, the pollution in the ion source is reduced and impurities can be ionized stably for many hours.

Figure 7:
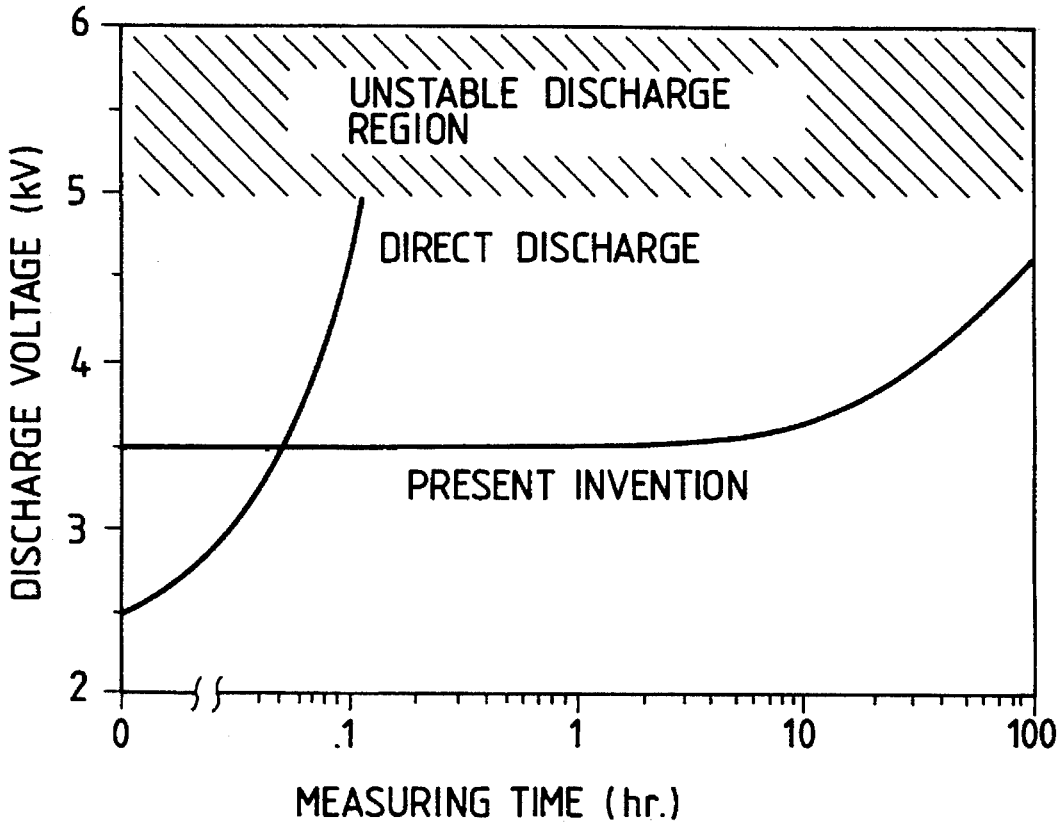
FIG. 7 is a graph showing the stability of discharge voltage in the atmospheric pressure ionization mass spectrometer of the present invention.

FIG. 7 shows the relationship between the measuring time for analysis of monosilane gas and the discharge voltage of corona discharge in the ion formation region. When monosilane gas is introduced directly into the ion formation region and ionized, solid silicon compounds are adhered to the needle electrode which generates corona discharge, so that the discharge voltage increases suddenly within several minutes, and stable discharge cannot be obtained, and the monosilane gas cannot be measured. On the other hand, in FIG. 1 in which monosilane gas is not introduced into the ion formation region, when the gas 1 is nitrogen gas at a flow rate of 1 lit/min, and the gas 3 is nitrogen gas at a flow rate of 0.5 1 lit/min, and the gas 2 is monosilane gas at a flow rate of 0.25 1 lit/min, stable discharge is obtained for more than 100 hours. This result is obtained when the diameter of the opening 16 shown in FIG. 1 is 8 mm. When the aperture diameter is made smaller, the stable time can be increased more.

To reduce the pollution more, a reaction in which the excess energy is smaller than that in Expression (7) can be used. Namely, this is a reaction that the reaction (7) is not generated and only the target impurity is ionized. For that purpose, a mixture of gas of molecules Y in which the proton affinity is larger than that of $SiH_4$ and smaller than that of the target impurity Z and hydrogen gas is used as gas 1 for forming primary ions. The reaction processes are as shown below.

$$H_2 \rightarrow H_2^+ \text{(Corona discharge)} \quad (10)$$

$$H_2^+ + H_2 \rightarrow H_3^+ + H \quad (11)$$

$$H_3^+ + Y \rightarrow YH^+ + H_2 \quad (12)$$

$$YH^+ + SiH_4 \rightarrow \text{NO reaction} \quad (13)$$

$$YH^+ + Z \rightarrow ZH^+ + Y \quad (14)$$

Expressions (10) to (12) are generated in the ion formation region and Expressions (13) and (14) are generated in the reaction region. $SiH_4$ does not take part in reaction. The target impurity Z is larger in the proton affinity than Y, so that it is ionized by the reaction (14).

In this case, it is necessary to pay attention to that hydrogen gas is diluted exceedingly by gas Y. When hydrogen gas is diluted, the amount of $H_3^+$ formed by the reaction (11) is reduced and the amount of $YH^+$ formed by the reaction (12) is also reduced. When the amount of $YH^+$ is reduced, the amount of ions $ZH^+$ of the target substance Z formed by the ion-molecule reaction (14) is also reduced, so that the detection sensitivity is reduced. However, since the reaction (12) is executed at about 1 atmosphere, the formation efficiency of $YH^+$ is extremely high. When Y exists in hydrogen gas in a concentration of about 100 to 600 ppm, $H_3^+$ is almost converted to $YH^+$, so that it is high enough. When the concentration of Y is about that, hydrogen gas will be diluted little, so that the amount of $H_3^+$ formed by the reaction (11) will be changed little.

It is desirable that the concentration of gas Y to be added to primary ion formation gas is so high that primary ions are changed to ions of the added gas Y fully in the ion formation region. The suitable concentration region of additional gas Y varies with the residence time of ions in the ion formation region. The residence time is about 60 μs for corona discharge and the mean reaction time of ion-molecule reaction is about 0.4 μs when the concentration of Y is 100 ppm. Therefore, the concentration 100 ppm of additional gas Y is sufficiently high for making the whole ions be comprised of the ion of the additional gas Y.

Figure 2:
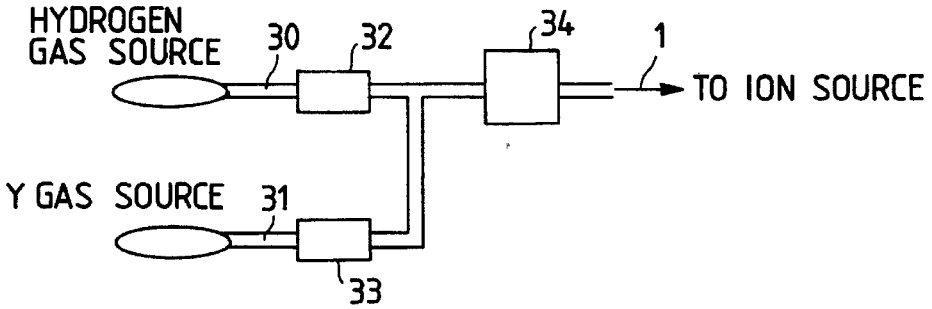
FIG. 2 is a schematic illustration showing a gas inlet of an embodiment of the present invention.

When it is troublesome to prepare a mixture of hydrogen gas and Y in low concentration practically, it is desirable to connect a hydrogen gas introduction tube 30 and a Y gas introduction tube 31 so as to prepare a mixture thereof, to remove impurities by a purifier 34, and to use it as ion formation gas 1, as shown in FIG. 2. It is difficult to control a concentration of several hundreds ppm by this method. However, by using valves or flow rate controllers 32 and 33, a concentration of about 6% of Y can be controlled. In the case of such dilution, a reduction in sensitivity due to dilution is about 6% and there are no practical problem caused.

Figure 8:
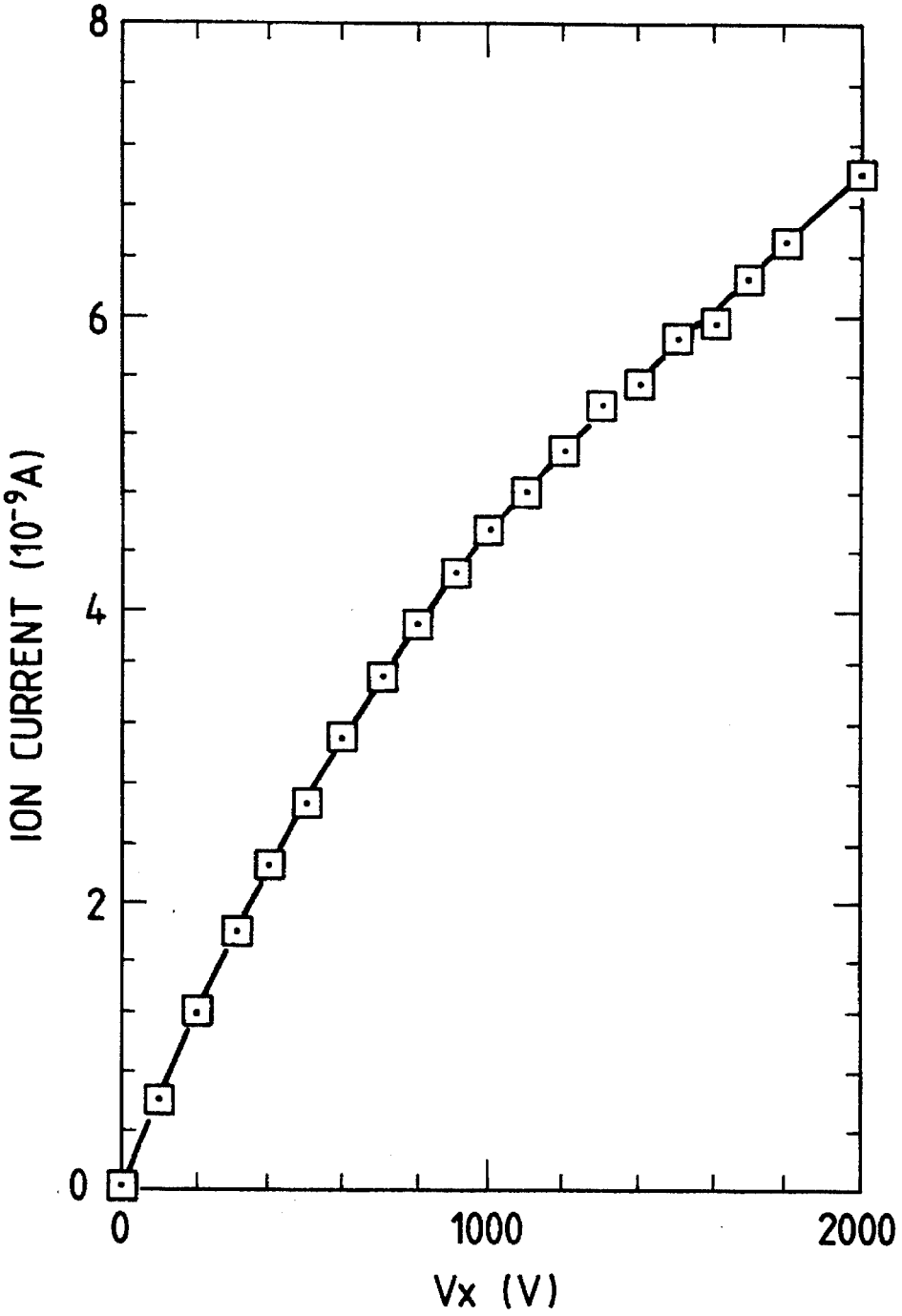
FIG. 8 is a graph showing the relationship between the ion current intensity and extraction voltage (Vx) in the atmospheric pressure ionization mass spectrometer of the present invention.

Efficient transmission of ions by the reaction region 10 and optimization of the ion-molecule reaction time are particularly important for performing highly sensitive analysis. FIG. 8 shows the relationship between the potential difference (Vx) between the first electrode and the second electrode shown in FIG. 1 and the ion intensity detected. The drawing shows that as Vx increases, the total ion intensity increases. This indicates that ions are transmitted efficiently by the potential difference. Therefore, application of voltage is effective in highly sensitive analysis. The ion intensity is measured by a detector 205 shown in FIG. 5.

Figure 9:
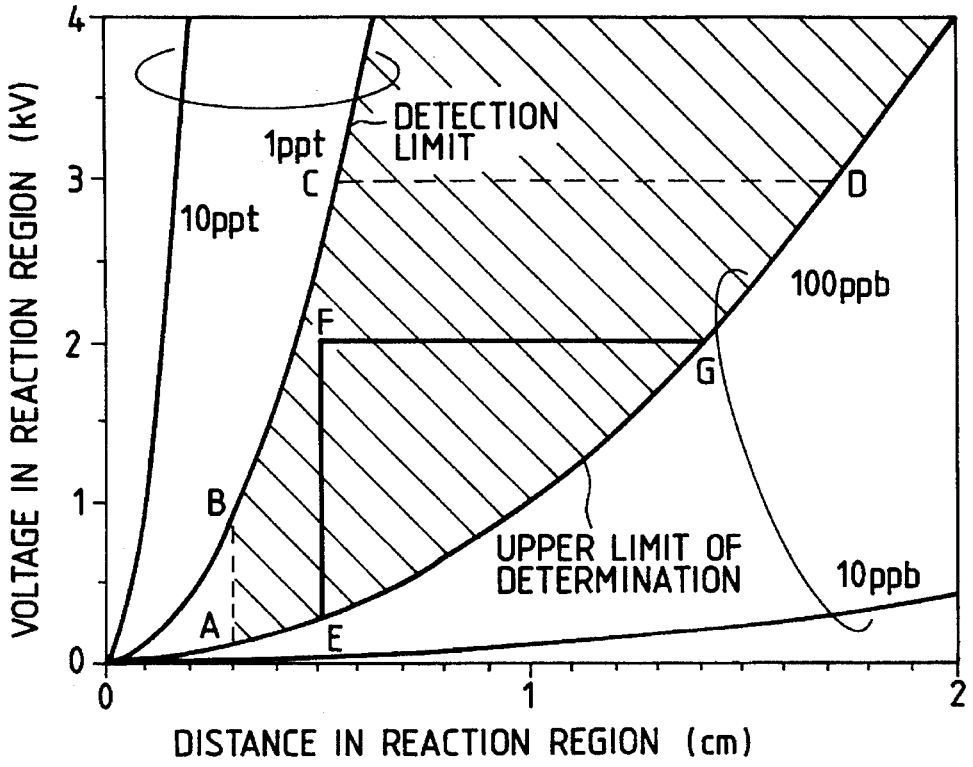
FIG. 9 is a graph showing the suitable relationship between the length L of the reaction region and extraction voltage (Vx) in the atmospheric pressure ionization mass spectrometer of the present invention.

The optimum condition for the reaction time is indicated by Expression (4). As shown by the region surrounded by the straight line EF, straight line FG, and curve GE shown in FIG. 9, it is desirable to set the voltage Vx to at most 2 kV and the distance L to at least 0.5 cm in addition to Expression (4). The reason is to prevent abnormal discharge and to mix primary ions and sample gas fully in the reaction region. In the embodiment shown in FIG. 1, V=1.4 kV and L=0.8 cm.

According to this embodiment, sample gas is mixed with primary ions and ionized highly efficiently with a small amount of excess energy by using the ion-molecule reaction, so that generation of substances formed by reaction due to discharge can be suppressed, and trace impurities can be ionized stably, and the labor necessary for maintaining the ion source can be reduced at the same time. By increasing the amount of detected ions by efficient transmission of ions by the electric field applied to the reaction region and by optimizing the ion-molecule reaction time in the reaction region, highly sensitive analysis can be performed.

Next, the result of actual measurement of monosilane gas by the present invention will be explained concretely.

Figure 10A:
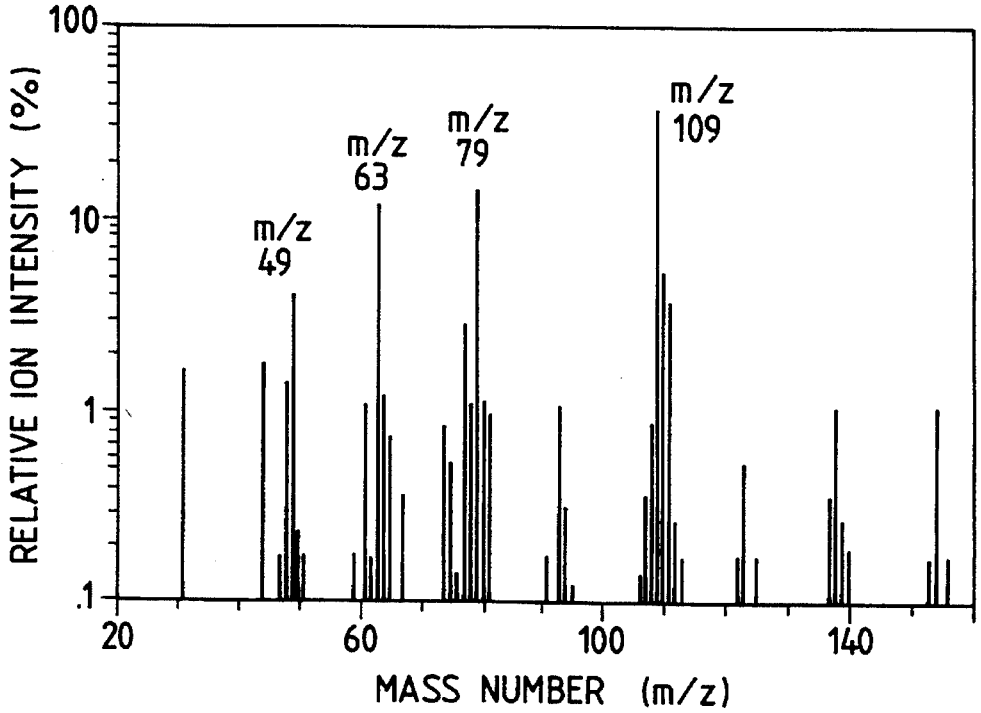
FIGS. 10*a* and 10*b* are graphs showing mass spectra of monosilane gas measured by the atmospheric pressure ionization mass spectrometer in an embodiment of the present invention.
Figure 10B:
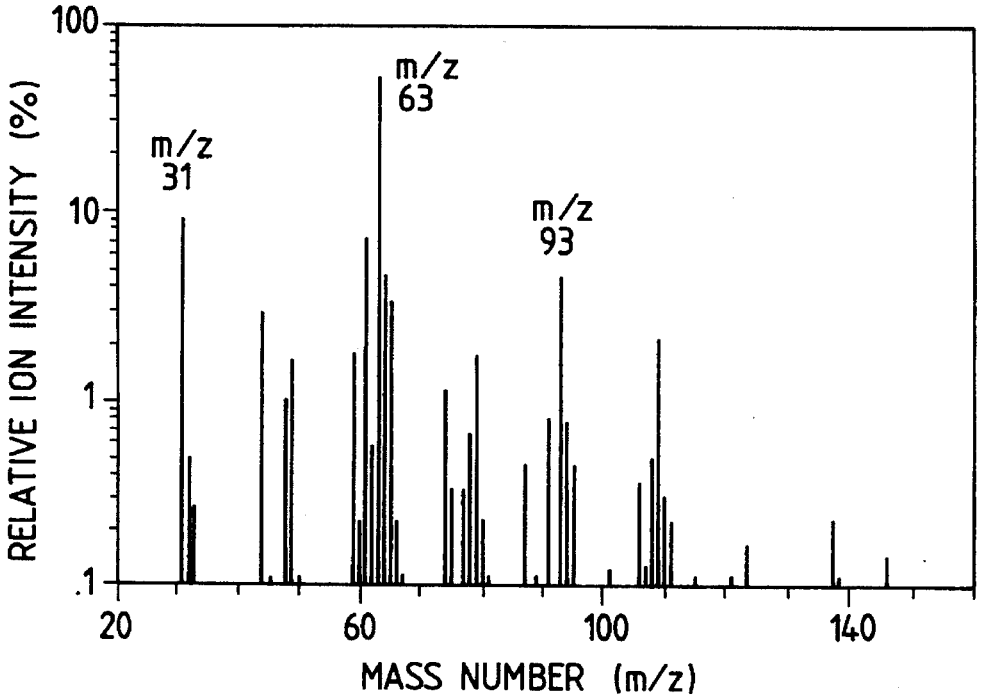

FIGS. 10*a* and 10*b* shows examples of mass spectra of monosilane gas measured by the apparatus shown in FIG. 1. The ion formation gas 1 is nitrogen gas and the flow rate is 1000 cc/min. The flow rate of gas 3 is 500 cc/min and the flow rate of sample gas 2 (monosilane gas) is 250 cc/min. FIG. 10*a* shows a spectrum when monosilane gas from the cylinder is introduced without being purified and FIG. 10*b* shows a spectrum when monosilane gas from the cylinder is purified by a miniature purifier mounted to the gas tube between the cylinder and analyzer. The vertical axis represents the relative ion intensity standardized by the total ion intensity. FIG. 10*a* shows that the intensities of ions of the mass numbers 49, 79, and 109 are particularly high.

Figure 11:
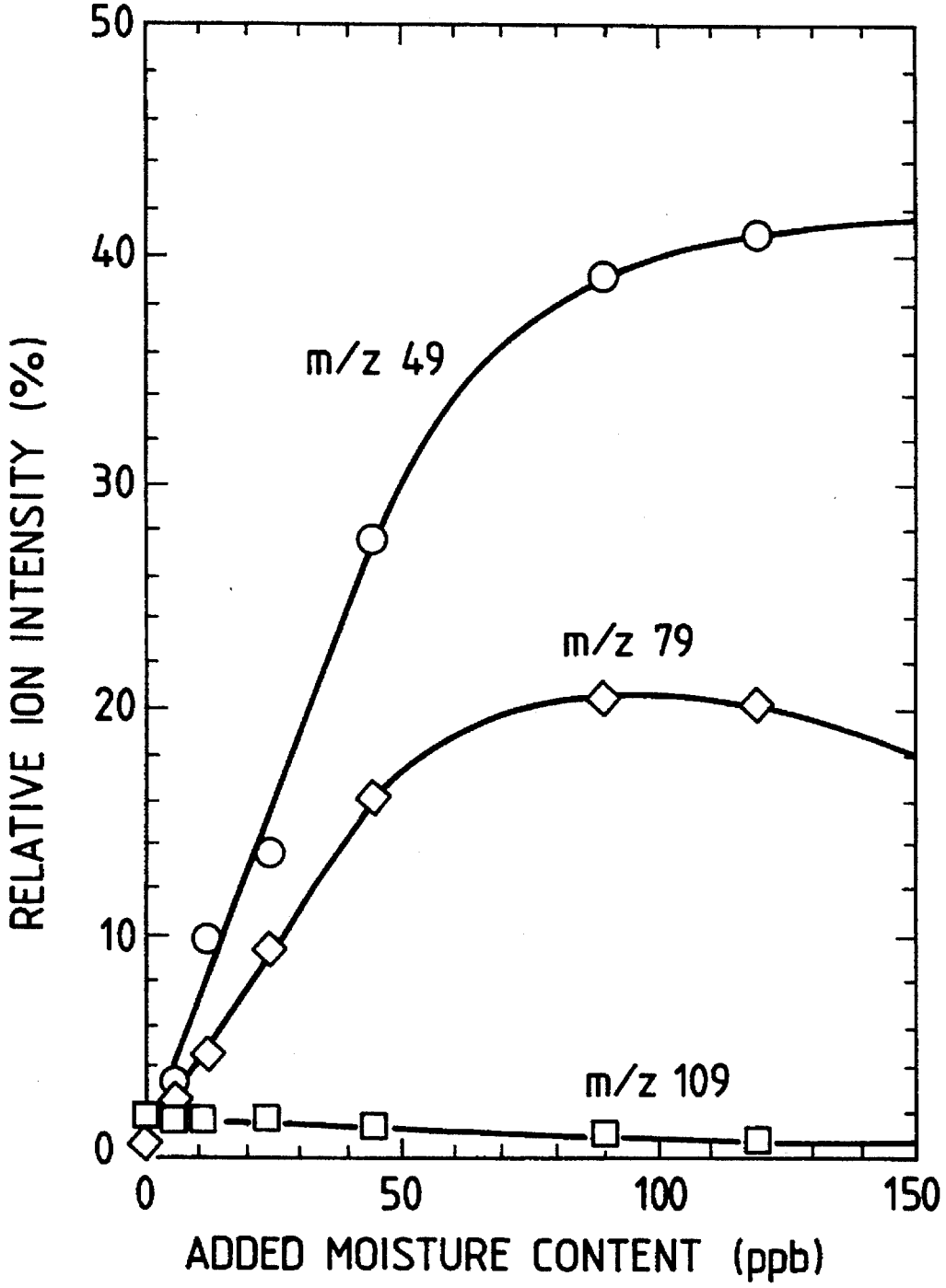
FIG. 11 is a graph showing the relationship between the ion intensities of the mass numbers 49, 79, and 109 and moisture content in monosilane gas measured by the atmospheric pressure ionization mass spectrometer in an embodiment of the present invention.

FIG. 11 shows the relationship between the ion intensity of the mass numbers 49, 79, and 109 when a very small amount of moisture is added to purified monosilane gas (in the state shown in FIG. 10*b*) and the added moisture content. As the moisture content increases, the ion intensities of the mass numbers 49 and 79 increase, though the ion intensity of the mass number 109 changes little. Therefore, it is found that the mass numbers 49 and 79 are for ions which are formed from moisture and the mass number 109 is for ions which are not formed from moisture. Ions of the mass number 49 are cluster ions $SiH_3OH_2^+$ formed by a reaction (Expression (8)) between water molecules ($H_2O$) and ions ($Si_2H_7^+$) of the mass number 63. Ions of the mass number 79 are cluster ions $Si_2H_5OH_2^+$ formed by a reaction between moisture and ions $Si_3H_9^+$ of the mass number 93 which is shown below.

$$Si_3H_9^+ + H_2O \rightarrow Si_2H_5OH_2^+ + SiH_4 \quad (15)$$

Since ions of the mass number 109 (chemical formula $Si_3H_9O^+$) are not formed from moisture, it is considered that they are formed from molecules of silicon oxide. Ions of the mass numbers 49, 79, and 109 are identified by the collision induced dissociation method (CID) as described later.

It is found that monosilane gas used in the semiconductor device manufacturing process contains generally impurities such as moisture and silicon oxide as mentioned above. The comparison of FIGS. 10*a* and 10*b* shows that the intensities of impurity ions of the mass numbers 49, 79, and 109 reduce due to installation of the purifier, while purified monosilane ions of the mass numbers 31 ($SiH_3^{30}$), 63, and 93 increase instead. It shows that this purifier is effective in removal of these impurities. The evaluation of impurities in monosilane gas and of the performance of the gas purifier mentioned above is made possible for the first time by the present invention and it is an important evaluation means for promoting high purification of monosilane gas further in the future.

Figure 12:
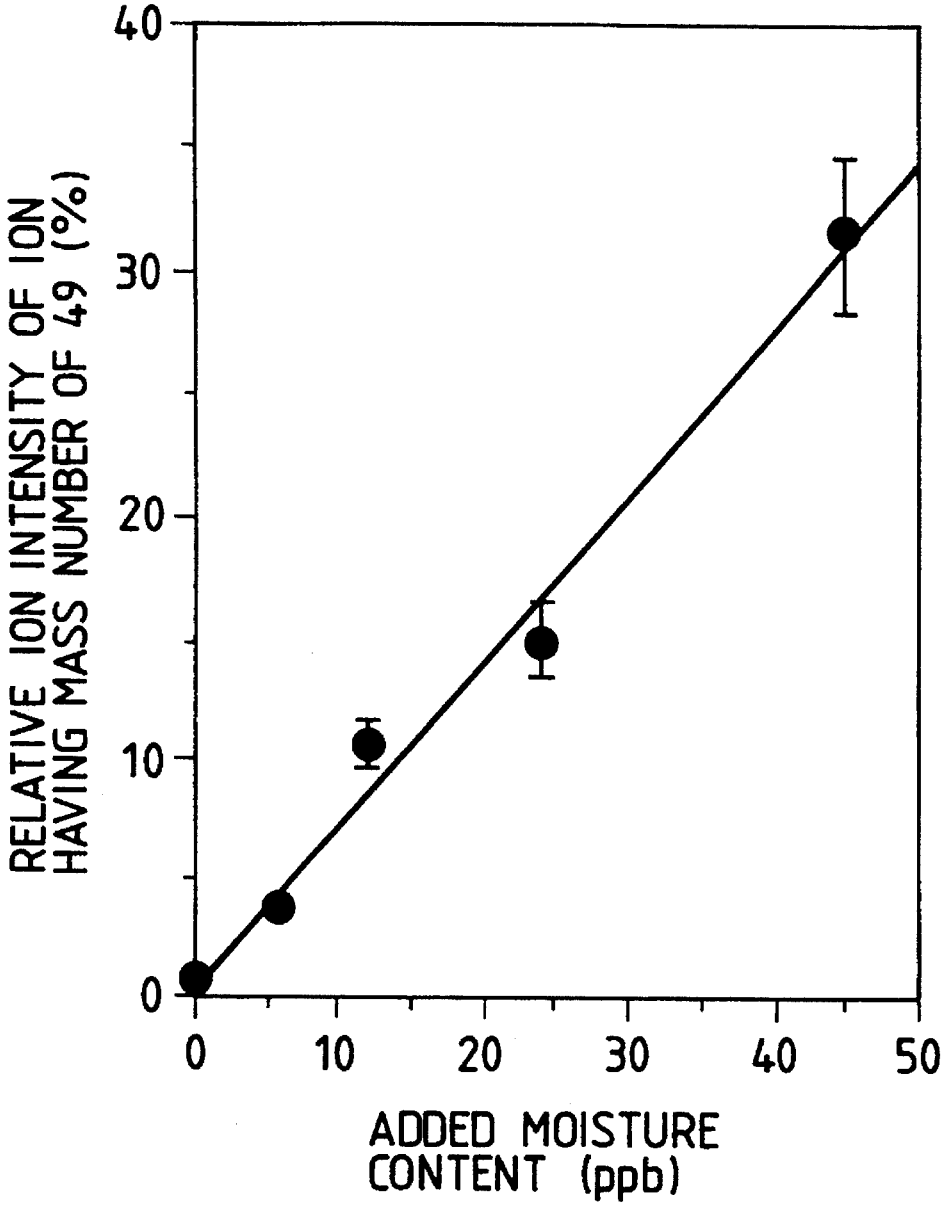
FIG. 12 is a graph showing a calibration curve of moisture in monosilane gas measured by the atmospheric pressure ionization mass spectrometer in an embodiment of the present invention.

Since ions of the mass numbers 49 and 79 depend on the moisture content as shown in FIG. 11, the relationship between ion intensity and moisture content can be used as a calibration curve of moisture contained in monosilane gas. FIG. 12 shows an example of a calibration curve of moisture in monosilane gas. The vertical axis represents the relative ion intensity of ions of the mass number 49. When the added moisture content is between 0 and 50 ppb, a satisfactory linear relation is obtained. The reason is that the reaction (8) is a primary reaction of moisture. The ion intensity of the mass number 49 when the added moisture content is 0 ppb indicates the background of moisture of this analysis system (impurities contained in the gas supply tube and gas itself included) and the value is 2.5 ppb. By improving the performance of the gas purifier and performing an electropolishing treatment and passivation treatment for the inside of the ion source and the inner surface of the gas introduction tube, this background can be decreased furthermore. An ion current of the mass number 49 equivalent to 2.5 ppb is observed at an SN ratio of at least 1000, so that moisture detection sensitivity of 2.5 ppt is obtained as performance of the apparatus. The reason that the detection sensitivity at such a ppt level and suitable determination range can be realized is that the ion-molecule reaction time in the reaction region is optimized according to Expression (4). Moisture in monosilane gas is considered as one of generation factors of particles of dust in the semiconductor device manufacturing process such as CVD (chemical vapor deposition) and particularly a reduction in content is requested. Moisture in monosilane gas can be analyzed quantitatively by the present invention, so that the present invention can contribute greatly to cleaning of the semiconductor device manufacturing process.

Figure 13:
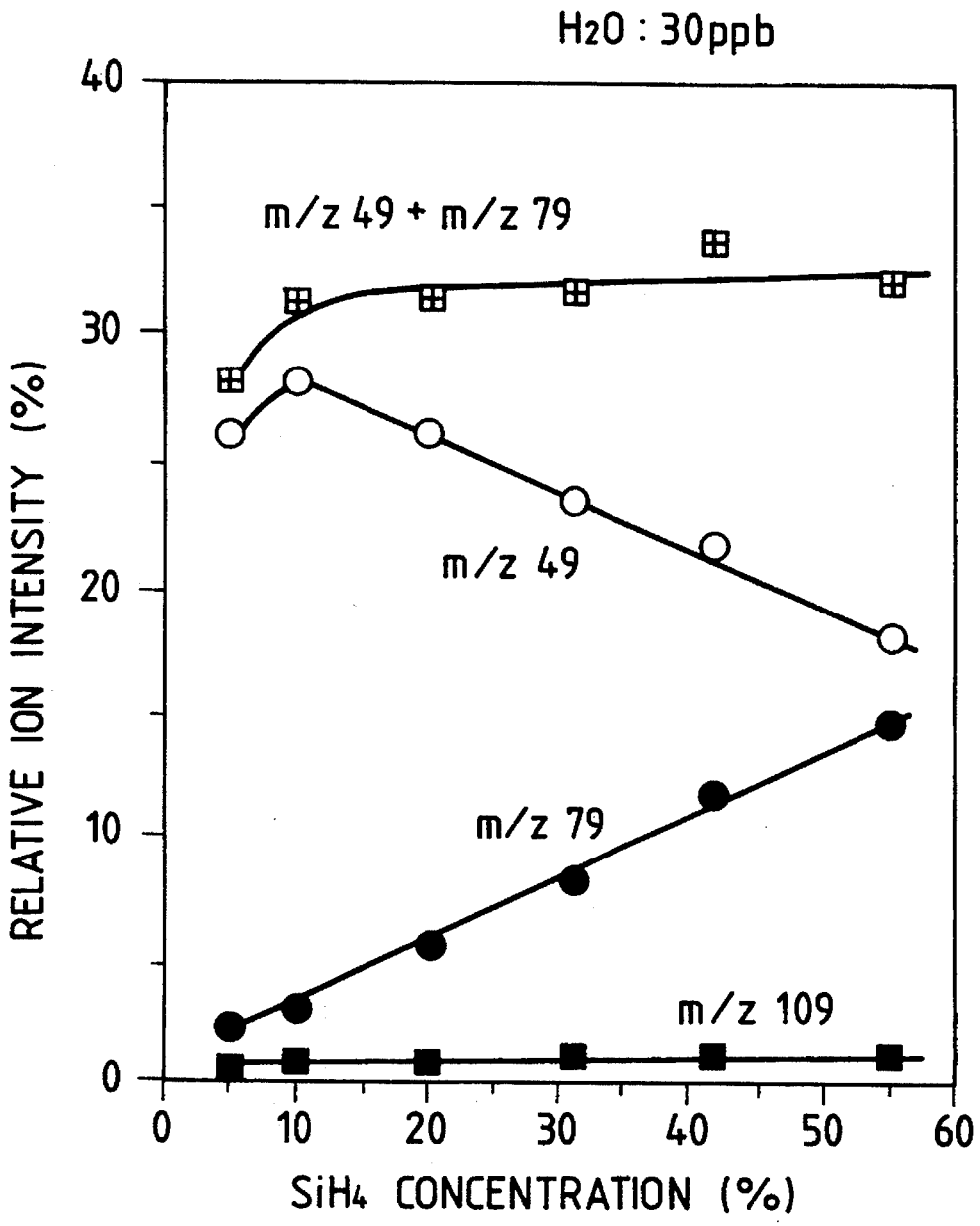
FIG. 13 is a graph showing the dependence of the ion intensities of the mass numbers 49 and 79 on the monosilane concentration.

The results when mixed gas of nitrogen containing moisture at a fixed content and monosilane is used as sample gas 1 and the ion intensities of the mass numbers 49 and 79 are measured by changing the mixing ratio of monosilane and nitrogen are shown in FIG. 13. The drawing shows that as the monosilane concentration increases, the ion intensity of the mass number 49 reduces and the ion intensity of the mass number 79 increases. However, the sum of both intensities is constant regardless of the monosilane concentration. From this result, it is found that the sum of the ion intensities of the mass numbers 49 and 79 can be used as an index of the moisture content which does not depend on the mixing ratio of monosilane and nitrogen.

Figure 14:
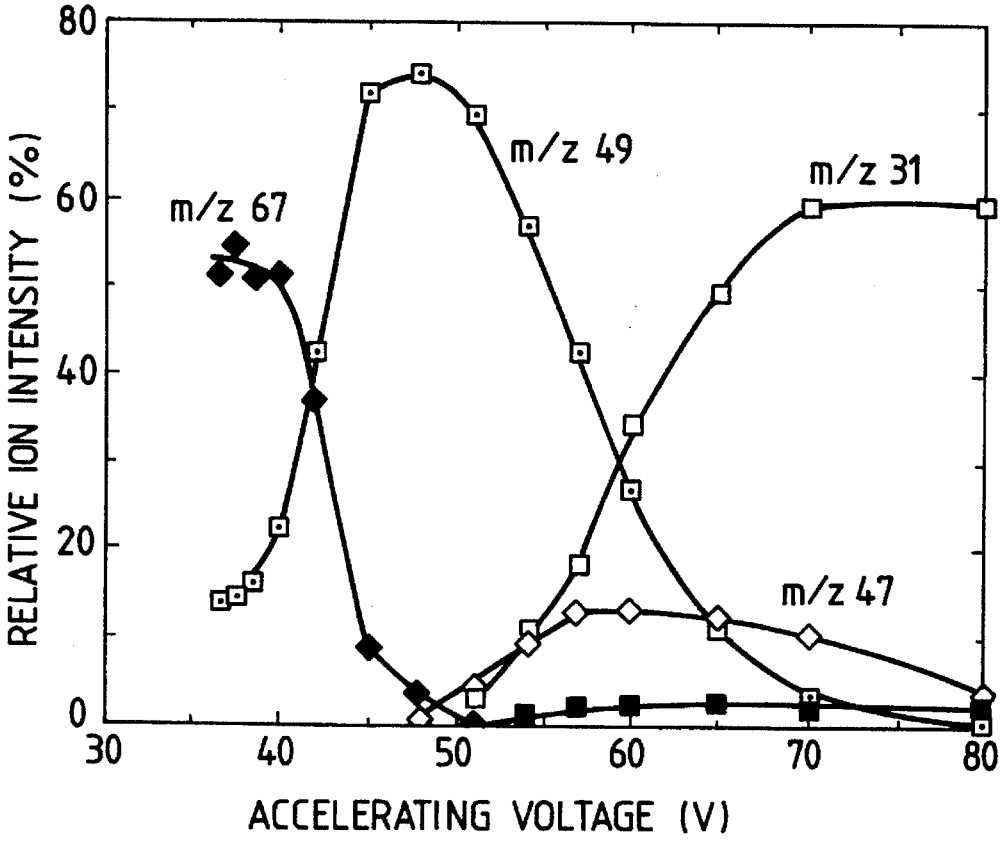
FIG. 14 is a graph showing the dissociation process of ions of the mass number 49 measured by the atmospheric pressure ionization mass spectrometer in an embodiment of the present invention.
Figure 15:
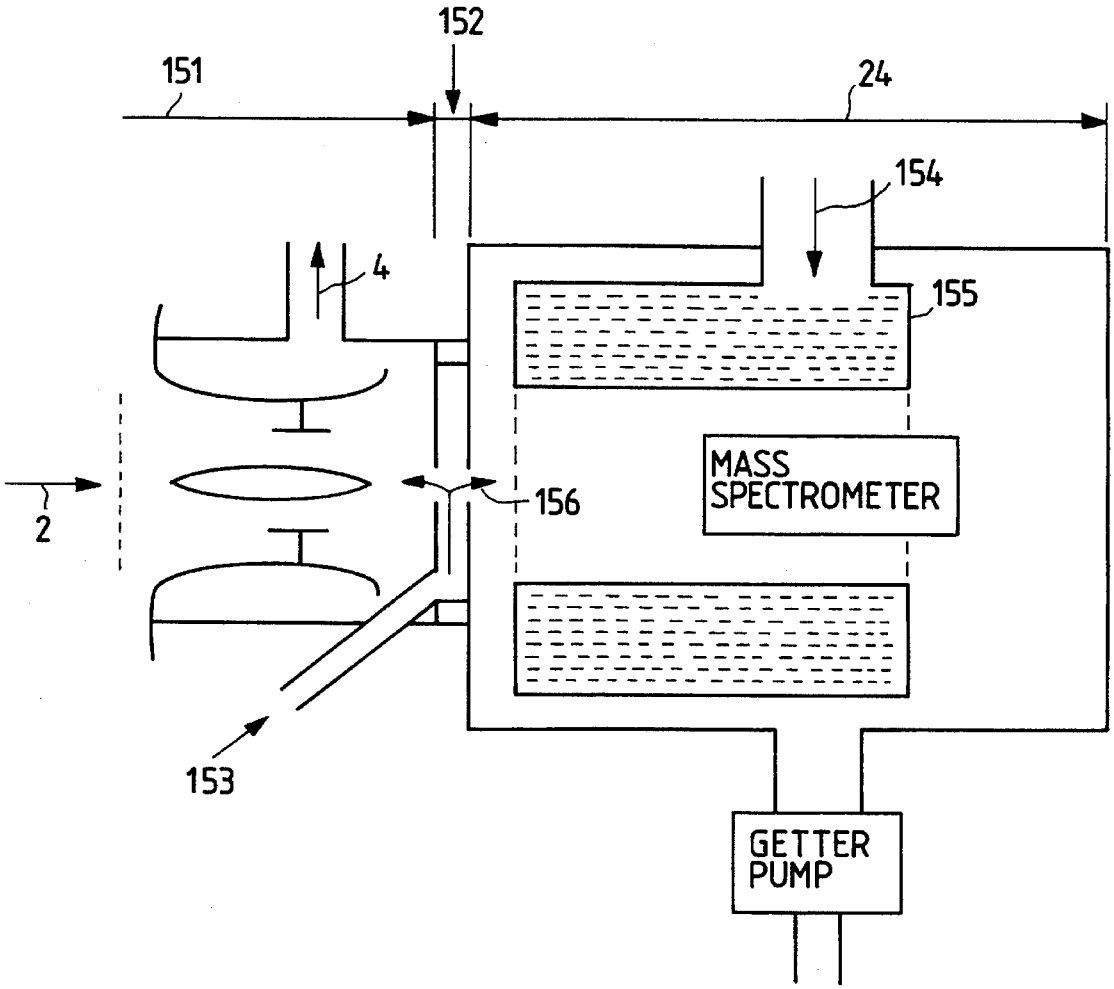
FIG. 15 PRIOR ART
FIGS. 15, 16, and 17 are schematic cross sectional views showing an atmospheric pressure ionization mass spectrometer of the prior art.
Figure 16:
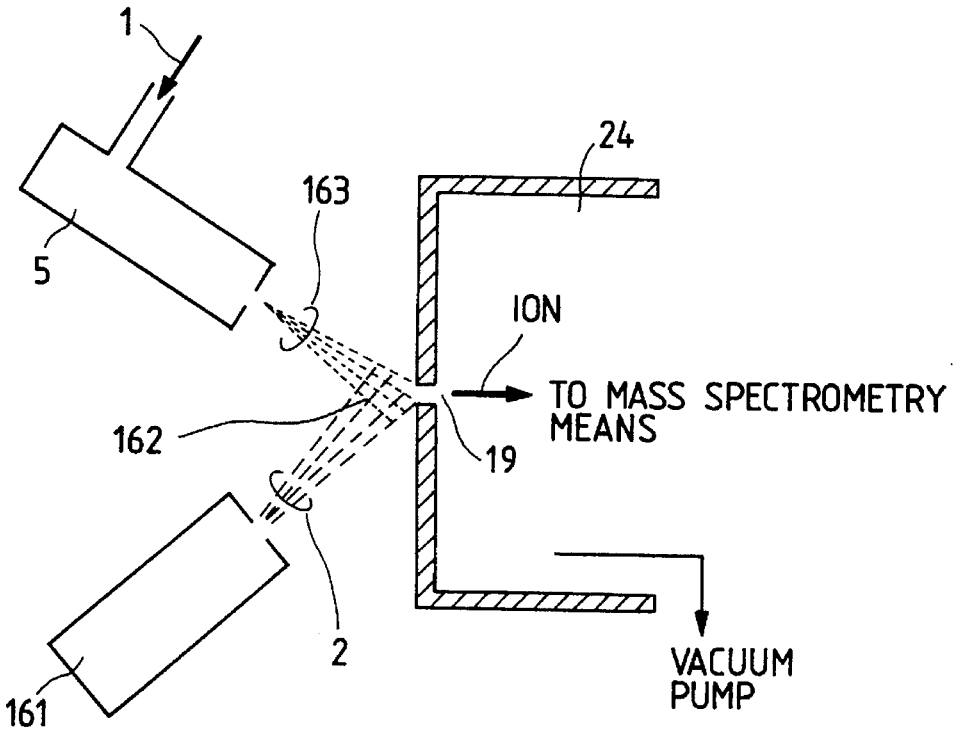
FIG. 16 PRIOR ART
Figure 17:
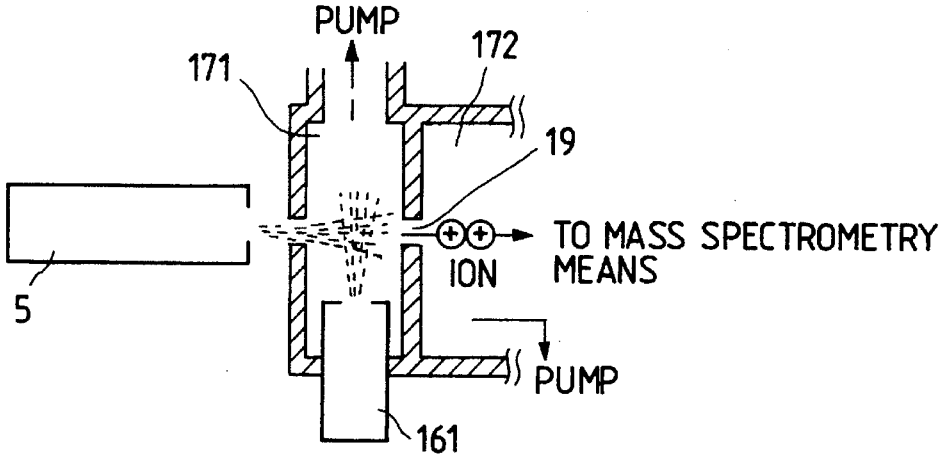
FIG. 17 PRIOR ART
Figure 18:
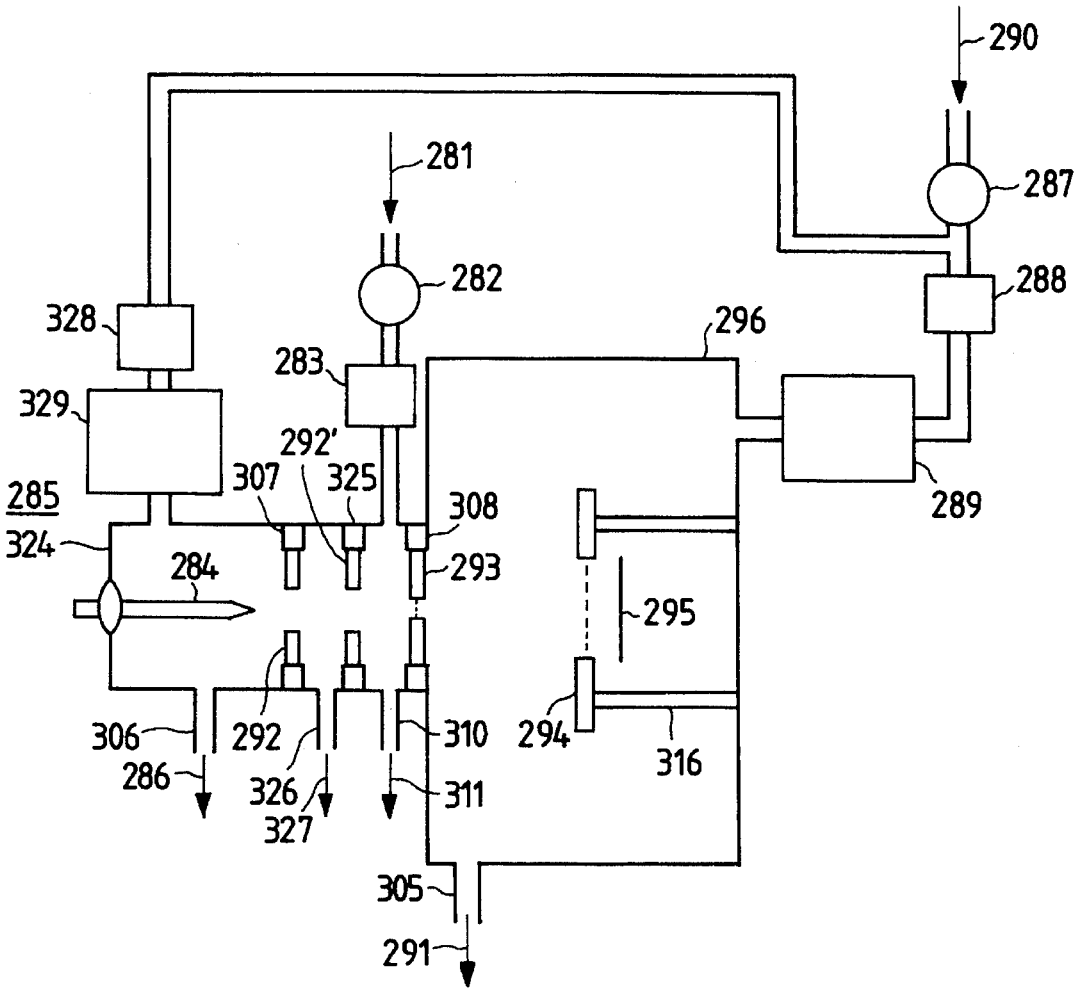
FIG. 18 PRIOR ART
FIG. 18 is a block diagram showing a gas analyzer of the prior art.

FIG. 14 shows an example that the process (CID process) that ions are dissociated by accelerating in a vacuum region (in, the differential pumping region 203 shown in FIG. 5 as described later) and by allowing them to collide with remaining gas any number of times is observed. FIG. 14 shows an example of the dissociation process of the mass number m/z 49 ($SiH_3OH_2$. As shown in FIG. 14, ions of the mass number 49 are dissociated to $SiH_3^+$ and $H_2O$ as the accelerating voltage increases. Namely, ions of the mass number 49 are molecule cluster ions which are obtained by bonding $SiH_3^+$ and $H_2O$. The process that ions ($Si_2H_5OH_2^+$) of the mass number 79 are dissociated to $Si_2H_5$ and $H_2O$ also can be observed. Namely, ions of the mass number 79 are molecule cluster ions which are obtained by bonding $Si_2H_5$ and $H_2O$. This result shows that to analyze moisture highly sensitively, it is important to measure at a low accelerating voltage so as to prevent cluster ions of the mass number 49 or 79 from dissociation inasmuch as is possible.

Figure 5:
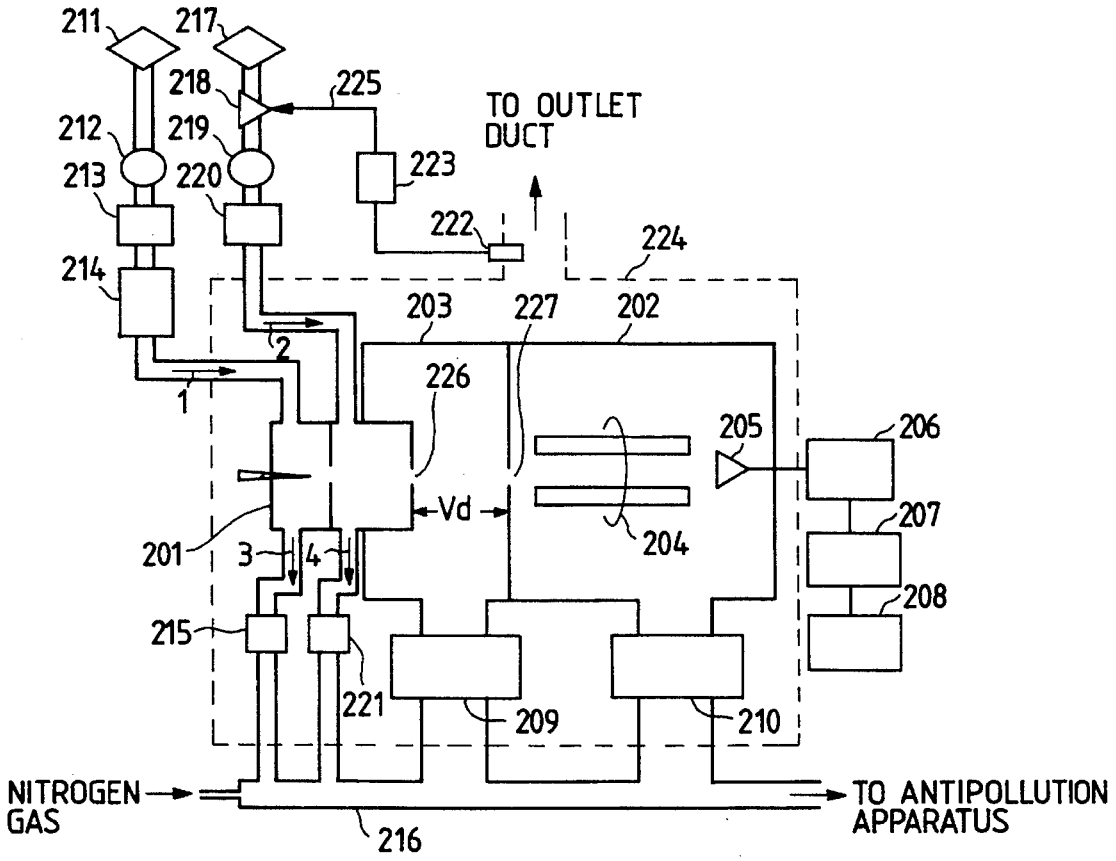
FIG. 5 is a block diagram showing the constitution of a gas analysis system using the atmospheric pressure ionization mass spectrometer of the present invention.
Figure 6:
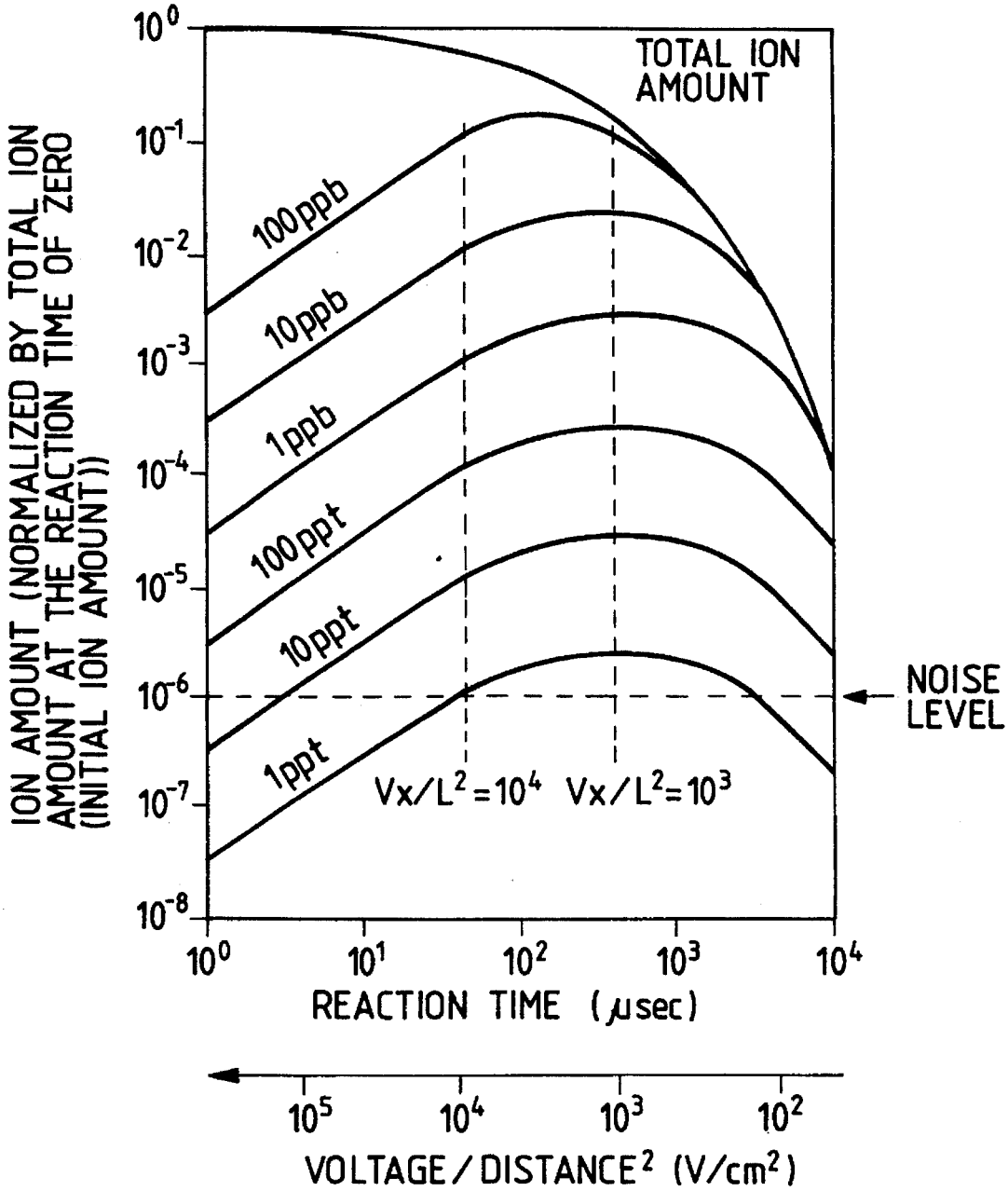
FIG. 6 is a graph showing the relationship between the impurity ion amount and reaction time.

Namely, since cluster ions such as $SiH_3OH_2^+$ (m/z: 49) or $SiH_3(OH_2)_2^+$ (m/z: 67) are used to analyze moisture ($H_2O$) quantitatively, it is necessary that these ions are not dissociated. Therefore, when the pressure of the differential pumping region 203 is about 10 Pa (generally 0.1 to 100 Pa), it is desirable that the accelerating voltage (potential difference Vd between an electrode having a first aperture 226 shown in FIG. 5 and an electrode having a second aperture 227) is at most 60 V. However, when the accelerating voltage is less than 30 V, the amount of ions decreases. Therefore, when the pressure of the differential pumping region 203 is about 10 Pa, an accelerating voltage between 30 V and 60 V is suitable. The dissociation voltage is in inverse proportion to the pressure when it is between 1 Pa and 100 Pa. The reason is that as the pressure increases, the collision rate increases and ions can be induced easily. Therefore, the accelerating voltage may be in inverse proportion to the pressure of the differential pumping region 203. For example, when the pressure is 20 Pa, an accelerating voltage of at least 30 V is suitable. In FIG. 5, the voltage of the electrode having the aperture 227 is generally 0 V.

Figure 3:
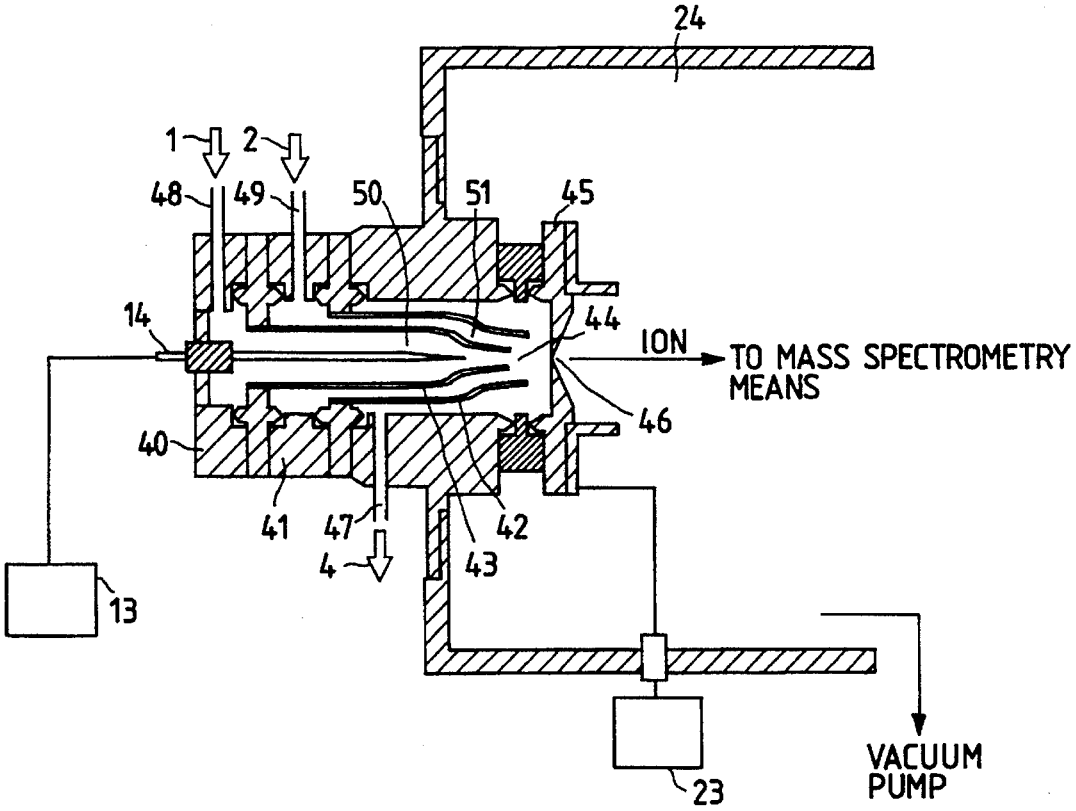
FIG. 3 is a schematic cross sectional view showing an atmospheric pressure ionization mass spectrometer of another embodiment of the present invention.

The accelerating voltage is applied to, for example, the second electrode 12 shown in FIG. 1 or the electrode 45 shown in FIG. 3. According to the present invention, no solid silicon is deposited on these electrodes, so that the electrodes will not be charged up. Therefore, the dissociation process as shown in FIG. 14 can be observed precisely. It is very useful to identify the type of ions observed or to analyze a mass spectrum.

As concretely explained above, regarding special material gas for semiconductors such as monosilane gas, by evaluating the purity of gas supplied from a gas purifier or gas cylinder, the present invention can be applied to performance evaluation of the purifier and quality management of cylinder gas. By branching and measuring gas supplied to a thin film manufacturing apparatus, the correlation between the thin film characteristics and gas purity can be examined. Furthermore, by observing the dissociation process of ions, fundamental knowledge on the molecular structure of ions and the ion-molecule reaction process can be obtained.

Embodiment 2

FIG. 3 shows another embodiment of the present invention. The ion formation region is a region 50 surrounded by a first body 40 and a first tube 43. Ion formation gas 1 is introduced from a first gas inlet 48 and ions are formed by corona discharge generated at the tip of a needle electrode 14 with high voltage applied to. A sample inlet 51 is a region surrounded by a second body 41, the first tube 43, and a second tube 42. Sample gas 2 is introduced from a second gas inlet 49 and mixed with ions which are supplied from an opening 44 by flow of gas 1, and an ion-molecule reaction is produced, and ions of the target substance are formed. Ions are introduced into the mass analysis region via an aperture 46 of an electrode 45 and mass-separated and detected. A part of mixed gas 4 of ion formation gas 1 and sample gas 2 flows from the aperture 46 of the electrode 45 together with ions and the remaining gas flows outside the second tube 42 and is ejected from a gas outlet 47. The reaction time is specified by the potential difference and distance between the needle electrode 14 and the electrode 45. The potential difference and distance specify the conditions for corona discharge at the same time. When the corona discharge current is set to 1 μA, stable discharge is obtained at 2 to 3 kV when the distance is 4 mm. The distribution of electric field between the needle electrode 14 and the electrode 45 is not uniform and concentrated at the tip of the needle unlike that in Embodiment 1. Therefore, the effective voltage for specifying the reaction time is about ⅕ of the discharge voltage and meets the requirement given in Expression (4), so that a detection limit on a ppt level is obtained.

According to this embodiment, sample gas 2 is prevented from flowing backward to the ion formation region by the double-tube structure, so that the ion source is not polluted by discharge and ions can be formed stably. In the region from the opening 44 to the aperture 46 where ions and sample gas are mixed, gas 1 and gas 2 flow in parallel and the dissipation of ions decreases, so that highly sensitive analysis can be performed. To increase the parallelism of flow of gas 1 and gas 2, it is desirable to narrow the tips (in the neighborhood Of the opening 44) of the first and second tubes. When the flow rates of gas 1 and gas 2 are adjusted so that the flow speeds of gas 1 and gas 2 in the neighborhood of the gas outlet become almost equal, the gas disturbance decreases and the dissipation of ions also decreases preferably.

When the double-tube structure is used in the same way as with this embodiment, it is considered to be desirable to make the gas flow speed in the inner tube and the gas flow speed in the outer tube (between the outer and inner tubes) almost equal in the neighborhood of the tips of the tubes.

When the flow speed in the inner tube is high, it is not desirable because ion formation gas and sample gas cannot be mixed sufficiently and the ion-molecule reaction becomes insufficient. When the flow speed in the outer tube is too high, it is not desirable because sample gas flows in the neighborhood of the discharge needle and discharge becomes unstable.

It is desirable to keep gas in the laminar flow state. When gas is in the turbulent flow state, corona discharge becomes unstable.

A distance of about 5 mm between the tip of the discharge needle 14 and the electrode 45 having the aperture 46 is suitable so as to obtain stable discharge.

Furthermore, it is desirable that both ion formation gas and sample gas flow toward the aperture 46 so as to promote gas mixing.

The suitable diameters of the inner and outer tubes depend on the volume flow rates of ion formation gas and sample gas. For a normal atmospheric pressure ionization mass spectrometer, a volume flow rate of about 0.1 to 1 lit/min is suitable. Therefore, it is desirable to set the diameter of the inner tube to at least 1 mm so as to prevent turbulent flow.

A typical example of diameters of the inner and outer tubes of the double-tube structure is as follows: The diameter of the parallel part of the inner tube is 4 to 8 mm, the diameter of the opening of the inner tube is 1 to 4 mm, the diameter of the parallel part of the outer tube is 6 to 12 mm, and the diameter of the opening of the ouster tube is 1.5 to 6 mm. It is generally acceptable to optimize the diameters of the inner and outer tubes experimentally.

In FIG. 3, reference numerals 13 and 23 indicate power sources and 24 a mass analysis region.

Embodiment 3

Figure 4:
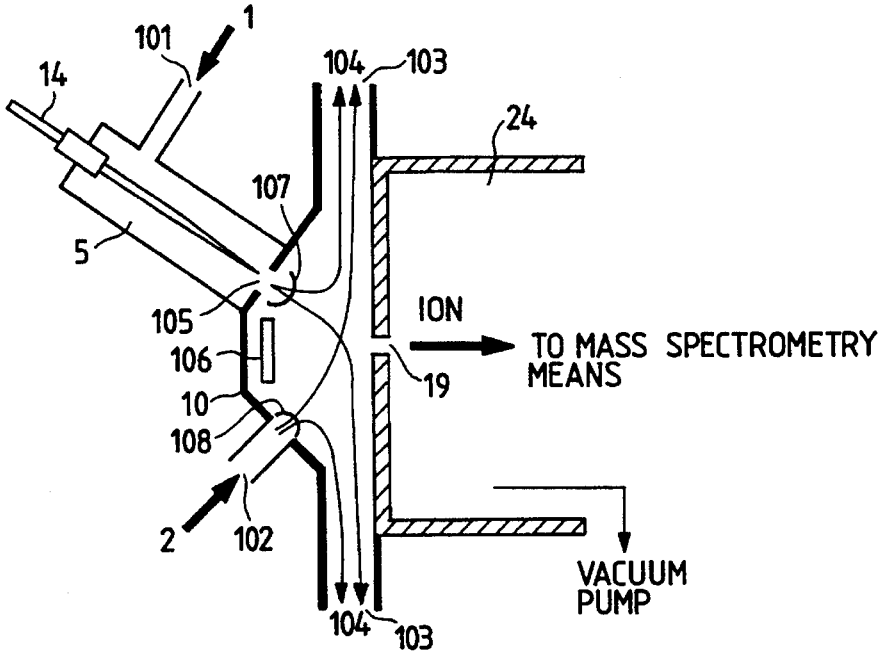
FIG. 4 is a schematic cross sectional view showing an atmospheric pressure ionization mass spectrometer of a further embodiment of the present invention.

FIG. 4 shows still another embodiment. Ion formation gas 1 is introduced into an ion formation region 5 from a gas inlet 101 and ionized by corona discharge generated at the tip of a needle electrode 14. The formed ions and gas 1 are introduced into a reaction region 10 from an opening 105. Ion formation gas flows typically as indicated by 107 and is ejected from a gas outlet 103 as exhaust gas 104. On the other hand, sample gas 2 is introduced into the reaction region 10 from a gas inlet 102, mixed with primary ion formation gas 1 and ions thereof in the reaction region, typically flows as indicated by 108, and is ejected from the gas outlet 103 as exhaust gas 104. In the reaction region, the substance to be analyzed in the sample gas is ionized by the ion-molecule reaction and the formed ions are introduced into a mass analysis region 24 via an aperture 19 by gas flow and mass-separated by the mass analysis means and detected.

In FIG. 4, furthermore an electrode 106 is arranged in the reaction region 10 and a voltage is applied to it from outside the reaction region 10 via an insulated terminal (not shown in the drawing). Since the reaction time is adjusted so as to meet the requirement given in Expression (4) by the potential difference and distance between the electrode 106 and the surface having the aperture 19, analysis on a level between ppt and ppb is made possible.

According to this embodiment, the ion formation region and sample gas inlet are installed separately and the sample gas is mixed with ions and ionized with a small amount of excess energy using the ion-molecule reaction. Therefore, generation of substances formed by reaction due to ionization can be suppressed, and trace components can be ionized stably, and the labor necessary to maintain the ion source can be reduced. In the reaction region 10, both primary ion formation gas 1 and sample gas 2 generally flow along the surface having the aperture. Therefore, gas will not flow back in the neighborhood of the opening 105 and the gas inlet 102. As a result, the disturbance of gas in the mixing region can be minimized. In other words, ions which are introduced from the ion formation region together with ion formation gas are transmitted efficiently to the neighborhood of the aperture and mixed with the sample gas in the neighborhood of the aperture, and ions of the target component are formed. Therefore, the amount of ions which are introduced into the mass analysis region from the aperture can be increased. Furthermore, ions are transmitted to the neighborhood of the aperture by the electric field applied to the reaction region, so that the amount of ions extracted from the aperture is increased furthermore and highly sensitive analysis can be performed.

Embodiment 4

FIG. 5 shows the entire constitution of a gas analysis system using the atmospheric pressure ionization mass spectrometer of the present invention. The atmospheric pressure ionization mass spectrometer consists of an ion source 201, a mass analysis region 202, and a differential pumping region 203 for connecting the ion source 201 and the mass analysis region 202. As an actual structure of the ion source 201, for example, the one shown in FIG. 1 may be used Ions formed by the ion source are introduced into the high vacuum region 202 via the differential pumping region 203, mass-separated by a mass analyzer 204, and detected as an ion current by a detector 205. The ion current is amplified by an amplifier 206 and recorded in a recorder 207 and a calculator 208. The differential pumping region 203 and the mass analysis region 202 are exhausted by vacuum pumps 209 and 210 respectively. Primary ion formation gas 1 and sample gas 2 are introduced into the ion source. Gas 1 is taken out from a gas source 211, and the pressure and flow rate thereof are controlled by a pressure regulator 212 and a flow rate regulator 213, and analysis obstruction substances such as moisture are removed by a purifier 214 such as a molecular sieve or liquid nitrogen trap, and then the gas 1 is introduced into the ion source 201. A part of gas 1 becomes gas 3 and is sent to a waste gas treatment system via a flow rate regulator 215 and an exhaust tube 216. Sample gas 2 is taken out from a gas source 217 and passes through a shut-off valve 218, and the pressure and flow rate thereof are controlled by a pressure regulator 219 and a flow rate regulator 220, and then the gas 2 is introduced into the ion source 201. Mixed gas 4 of a part of primary ion formation gas 1 and a part of sample gas 2 passes through a flow rate measuring instrument 221 and then the exhaust tube 216 and is sent to the waste gas treatment system. Nitrogen gas is always supplied to the exhaust tube 216 and will not remain in the exhaust tube. The system is surrounded by a housing 224 and the housing is connected to an outlet duct. The outlet duct sucks air in the housing. A sensor 222 is installed at the entrance of the outlet duct. When the sensor detects leakage of sample gas, it issues a control signal 225 for closing the shut-off valve 218 via a controller 223 so as to shut off supply of sample gas 2.

When the ion source shown in FIG. 3 or 4 is applied to the apparatus shown in FIG. 5, there is no flow of gas 3. Therefore the gas tube from the ion source 201 to the exhaust tube 216 via the flow rate regulator 215 is not necessary.

A mass flow controller is used as a flow rate regulator.

When the aforementioned atmospheric pressure ionization mass spectrometer of the present invention is incorporated into a silicon thin film manufacturing apparatus, by analyzing impurities of material gas and monitoring the amount thereof, silicon thin films can be manufactured and high quality silicon thin films can be obtained.

What is claimed is:

1. An atmospheric pressure ionization mass spectrometer comprising i) a first chamber which has an inlet for a first gas and means for ionizing the first gas introduced from the inlet and forming primary ions, ii) a second chamber at a pressure substantially equal to the atmospheric pressure which has an inlet for a second gas including a target substance to be analyzed, the second chamber being connected to said first chamber via a barrier having an opening through which the first gas containing said primary ions flows in, and having an electric field for transmitting ions, and iii) a third chamber which has an aperture, the third chamber being connected to said second chamber via a first electrode for forming said electric field, having mass analysis means, and being exhausted in a suitable vacuum for mass analysis, wherein said second gas introduced into said second chamber and said primary ions flowing into said second chamber are mixed in said second chamber, and the target substance to be analyzed is ionized by an ion-molecule reaction so as to form secondary ions, and said secondary ions are transmitted to said aperture by said electric field in said second chamber and flow into said third chamber, and said secondary ions are mass-analyzed by said mass analysis means.

2. An atmospheric pressure ionization mass spectrometer according to claim 1, wherein said barrier having an opening is a second electrode which forms an electric field in the second chamber by using said first electrode between said second chamber and third chamber and a distance L (cm) and a potential difference Vx (volt) between said first electrode and said second electrode, wherein Vx and L satisfy the relationship of $10^3<Vx/L^2<10^4$.

3. An atmospheric pressure ionization mass spectrometer according to claim 2, wherein said potential difference Vx is at most 3 kV and said distance L is at least 3 mm.

4. An atmospheric pressure ionization mass spectrometer according to claim 2, wherein said potential difference Vx is at most 2 kV and said distance L is at least 5 mm.

5. An atmospheric pressure ionization mass spectrometer according to claim 1, wherein the gas pressure in said first chamber is higher than the gas pressure in said second chamber so as to prevent gas in the second chamber from flowing into the first chamber and wherein primary ions formed in the first chamber are introduced into the second chamber by the pressure difference.

6. An atmospheric pressure ionization mass spectrometer according to claim 1, wherein an outlet for said first gas is installed in said first chamber, and an outlet for said second gas is installed in said second chamber, and first and second gas flow rate control means are installed at the inlet and outlet of said first gas, respectively, and wherein said first and second gas flow rate control means function so as to control an exhaust flow rate of said first gas to be smaller than an introduction flow rate, such that said first gas is supplied to the second chamber from said opening together with ions, while gas in the second chamber is prevented from flowing into the first chamber.

7. An atmospheric pressure ionization mass spectrometer according to claim 6, wherein said first and second gas flow rate control means are mass flow controllers.

8. An atmospheric pressure ionization mass spectrometer according to claim 1, wherein a gas inlet and a gas outlet for said second gas are installed on the second electrode on a boundary between said first chamber and second chamber, the second electrode being used for formation of the electric field and introduction and exhaust of the second gas.

9. An atmospheric pressure ionization mass spectrometer according to claim 1, wherein the first gas is ionized by a corona discharge generated at the tip of a needle electrode in said first chamber.

10. An atmospheric pressure ionization mass spectrometer according to claim 1, wherein the first chamber which has a needle electrode inside which ionizes the first gas by corona discharge and together with the inlet of the second gas forms double tubes, wherein a first tube is located inside a second tube and with the inlet of the second gas representing the second tube, and the second chamber is structured so that the double tubes extend inside of the second chamber, and said double tubes are installed so that an opening of said double tubes is located opposite to the aperture at the entrance of said third chamber, and the first gas and second gas flow in parallel toward said aperture, and the reaction time of an ion-molecule reaction caused by mixing of the first gas and second gas in the neighborhood of the opening of said double tubes is a function of the potential difference and distance between said needle electrode and said first electrode.

11. An atmospheric pressure ionization mass spectrometer according to claim 10, wherein the diameter of each of said double tubes becomes narrower toward the opening in the neighborhood of the opening so as to prevent said second gas from flowing into the first chamber.

12. An atmospheric pressure ionization mass spectrometer according to claim 1, wherein a gas exhaust means of said second chamber is installed in contact with a surface of said third chamber which has an aperture and in parallel with said surface, so that the effect of dissipation of ions due to disturbance of the gas flow caused by mixing of the first gas and second gas is reduced.

13. An atmospheric pressure ionization mass spectrometer according to claim 1, wherein said first gas is gas of molecules which have a higher ionization potential than molecules of the target substance to be analyzed in said second gas, and form ions of said target substance to be analyzed by ion-molecule reaction.

14. An atmospheric pressure ionization mass spectrometer according to claim 13, wherein said second gas is a silane gas, and said first gas has molecules which have a higher ionization potential than molecules of impurities in said silane gas, and forms ions of impurities of said silane gas by ion-molecule reaction, and wherein decomposition of said silane gas molecules is reduced and generation of solid silicon compounds is also reduced at the same time.

15. An atmospheric pressure ionization mass spectrometer according to claim 13, wherein said first gas is a mixture of gas of first molecules which have a medium proton affinity between those of molecules of said second gas and molecules of the target substance to be analyzed contained in said second gas and hydrogen, and wherein the mixture of gas of first molecules is such that only said target substance to be analyzed is ionized by a proton shift reaction and molecules of said second gas are not reacted upon.

16. An atmospheric pressure ionization mass spectrometer according to claim 13, wherein said first gas is a mixture of gas of first molecules which have a medium ionization potential between those of molecules of said second gas and molecules of the target substance to be analyzed and gas of second molecules which have a higher ionization potential than that of said gas of the first molecules, and wherein the mixture of gas of first molecules is such that ions of said first gas and second gas are mixed, and only said target substance to be analyzed is ionized by a charge-transfer reaction and molecules of said second gas are not reacted upon.

17. An atmospheric pressure ionization mass spectrometer according to claim 13, wherein said first gas is a mixture of gas of first molecules which have a medium electron affinity between those of molecules of said second gas and molecules of the target substance to be analyzed and gas of second molecules which have a smaller electron affinity than that of said gas of the first molecules, and wherein the mixture of gas of first molecules is such that only said target substance to be analyzed is ionized by a negative ion reaction and molecules of said second gas are not reacted upon.

18. An atmospheric pressure ionization mass spectrometer according to claim 13, wherein said first gas is a mixture of gas of first molecules which have a medium ionization potential or proton affinity between those of molecules of the target substance to be analyzed and an obstruction substance in said second gas and gas of second molecules which have a smaller proton affinity or a higher ionization potential than that of said gas of the first molecules, and wherein the mixture of gas of first molecules is such that only said target substance to be analyzed is ionized by an ion-molecule reaction, and ions of the obstruction substance are not formed.

19. An atmospheric pressure ionization mass spectrometer according to claim 13, wherein said second gas is a silane gas and said first gas is a gas having molecules with a lower proton affinity than molecules of impurities in silane gas and forms ions of impurities of said silane gas by reaction, and wherein decomposition of silane gas molecules is reduced and generation of solid silicon compounds is also reduced at the same time.

20. An atmospheric pressure ionization mass spectrometer according to claim 13, wherein said second gas is a silane gas and said first gas is a gas having molecules with a lower electron affinity than molecules of impurities in said silane gas and forms ions of impurities of said silane gas by reaction, and further wherein decomposition of said silane molecules is reduced and generation of solid silicon compounds is also reduced at the same time.

21. An atmospheric pressure ionization mass spectrometer according to claim 13, wherein said second gas is a silane gas and said first gas is a gas having molecules of a higher ionization potential than molecules of impurities in said silane gas, and forms ions of impurities of said silane gas by reaction, and wherein impurities in the silane gas are ionized by an ion-molecule reaction by mixing ions of the first gas and the second gas, and further wherein decomposition of silane gas molecules is reduced and generation of solid silicon compounds is also reduced at the same time.

22. An atmospheric pressure ionization mass spectrometer according to claim 13, wherein said second gas is a silane gas and said first gas is a gas having molecules of a lower proton affinity than molecules of impurities in said silane gas and forms ions of impurities of said silane gas by reaction, and wherein impurities in the silane gas are ionized by an ion-molecule reaction by mixing ions of the first gas and the second gas, and further wherein decomposition of silane gas molecules is reduced and generation of solid silicon compounds is also reduced at the same time.

23. An atmospheric pressure ionization mass spectrometer according to claim 13, wherein said second gas is a silane gas and said first gas is gas having molecules of a lower electron affinity than molecules of impurities in said silane gas and forms ions of impurities of said silane gas by reaction, and wherein,impurities in said silane gas are ionized by an ion-molecule reaction by mixing ions of the first gas and the second gas, and further wherein decomposition of silane gas molecules is reduced and generation of solid silicon compounds is also reduced at the same time wherein mixed gas containing said gas, and impurities in the silane gas are ionized by an ion-molecule reaction by mixing ions of the first gas and the second gas.

24. A silicon thin film manufacturing apparatus having a means for analyzing impurities of material gas, said analyzing means including the atmospheric pressure ionization mass spectrometer defined in claim 1.

25. An atmospheric pressure ionization mass spectrometer according to claim 1, wherein said first gas is gas of molecules which have a lower proton affinity than molecules of the target substance to be analyzed in said second gas, and form ions of said target substance to be analyzed by reaction.

26. An atmospheric pressure ionization mass spectrometer according to claim 1, wherein said first gas is gas of molecules which have a lower electron affinity than molecules of the target substance to be analyzed in said second gas, and form ions of said target substance to be analyzed by reaction.

27. An atmospheric pressure ionization mass spectrometer according to claim 1, wherein said first gas is gas of molecules which have a higher ionization potential than molecules of the target substance to be analyzed in said second gas, and wherein mixed gas containing said gas and the target substance to be analyzed is ionized by an ion-molecule reaction by mixing ions of the first gas and the second gas.

28. An atmospheric pressure ionization mass spectrometer according to claim 1, wherein said first gas is gas of molecules which have a lower proton affinity than molecules of the target substance to be analyzed in said second gas, and wherein mixed gas containing said gas and the target substance to be analyzed is ionized by an ion-molecule reaction by mixing ions of the first gas and the second gas.

29. An atmospheric pressure ionization mass spectrometer according to claim 1, wherein said first gas is gas of molecules which have a lower electron affinity than molecules of the target substance to be analyzed in said second gas, and wherein mixed gas containing said gas and the target substance to be analyzed is ionized by an ion-molecule reaction by mixing ions of the first gas and the second gas.

* * * * *